US010309164B2

(12) United States Patent
Angman

(10) Patent No.: US 10,309,164 B2
(45) **Date of Patent: *Jun. 4, 2019**

(54) MIXED FORM TUBULAR CENTRALIZERS AND METHOD OF USE

(71) Applicant: Per Angman, Calgary (CA)

(72) Inventor: Per Angman, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/123,998

(22) Filed: Sep. 6, 2018

(65) Prior Publication Data

US 2019/0024463 A1 Jan. 24, 2019

Related U.S. Application Data

(63) Continuation of application No. 15/150,359, filed on May 9, 2016, now Pat. No. 10,100,588, which is a continuation-in-part of application No. 14/647,264, filed as application No. PCT/CA2013/050919 on Nov. 29, 2013, now Pat. No. 10,000,978.

(60) Provisional application No. 62/158,619, filed on May 8, 2015, provisional application No. 61/731,393, filed on Nov. 29, 2012.

(51) Int. Cl.
*E21B 17/10* (2006.01)
*E21B 17/16* (2006.01)

(52) U.S. Cl.
CPC ..... *E21B 17/1078* (2013.01); *E21B 17/16* (2013.01)

(58) Field of Classification Search
CPC ..... E21B 17/10; E21B 17/1078; E21B 17/16
See application file for complete search history.

(56) References Cited

U.S. PATENT DOCUMENTS 1,907,825 A * 5/1933 Johnson ..... E21B 17/1078 166/241.6
2,318,878 A * 5/1943 Miller ..... E21B 17/1042 175/325.5
2,860,013 A * 11/1958 Medearis ..... E21B 17/105 175/325.6
3,088,532 A * 5/1963 Kellner ..... E21B 4/18 166/212
4,059,164 A * 11/1977 Farris ..... E21B 7/062 175/322
4,549,613 A * 10/1985 Case ..... E21B 10/26 175/325.2
5,174,679 A * 12/1992 Wolf ..... E21B 17/105 166/241.1
5,692,563 A * 12/1997 Krueger ..... E21B 17/1014 166/241.6

(Continued)

FOREIGN PATENT DOCUMENTS

GB 2385342 A * 8/2003 ..... E21B 17/10

*Primary Examiner* — Matthew R Buck
(74) *Attorney, Agent, or Firm* — Parlee McLaws LLP (CGY); Linda Thompson; Sean Goodwin

(57) ABSTRACT

A centralizer is provided for centralizing a tubular, such as a drill pipe, in a wellbore. The centralizer has a resilient inner sleeve having three or more protruding members extending radially outwardly from an outer surface of the inner sleeve. The inner sleeve receives the tubular and spaces the tubular from the wellbore. The centralizer further has an outer support body for receiving the outer surface of inner sleeve. The protruding members may be resilient protrusions, hard protrusions and a combination thereof. A method for drilling wellbore using one or more types of centralizers is also provided.

12 Claims, 31 Drawing Sheets

(56) References Cited

U.S. PATENT DOCUMENTS 5,803,193 A * 9/1998 Krueger ..... E21B 17/1064 166/241.6
5,833,018 A * 11/1998 von Gynz-Rekowski ..... E21B 17/1064 175/325.3
6,152,220 A * 11/2000 Carmichael ..... E21B 17/1078 166/173
6,453,999 B1 * 9/2002 Reinholdt ..... E21B 17/1057 166/241.3
6,484,803 B1 * 11/2002 Gremillion ..... E21B 17/1028 166/241.1
6,830,102 B2 * 12/2004 Kirk ..... E21B 17/1042 166/241.6
7,096,940 B2 * 8/2006 Baxter ..... E21B 17/1085 166/241.6
7,409,758 B2 * 8/2008 Le ..... E21B 17/1007 166/212
7,493,949 B2 * 2/2009 Baird ..... E21B 10/26 166/173
7,810,573 B2 * 10/2010 Baird ..... E21B 10/26 166/242.1
7,942,199 B2 * 5/2011 Angman ..... E21B 17/042 166/206
8,167,034 B2 * 5/2012 Castro ..... E21B 17/1078 166/241.6
8,511,377 B2 * 8/2013 Casassa ..... E21B 17/1042 166/241.6
10,000,978 B2 * 6/2018 Angman ..... E21B 17/10
2005/0241822 A1 * 11/2005 Gremillion ..... E21B 17/1028 166/241.6
2006/0231250 A1 * 10/2006 Slack ..... B21D 17/00 166/241.6
2008/0164019 A1 * 7/2008 Angman ..... E21B 17/1042 166/241.6
2016/0251898 A1 * 9/2016 Angman ..... E21B 17/1078 175/57

* cited by examiner

MIXED FORM TUBULAR CENTRALIZERS AND METHOD OF USE

CROSS-REFERENCE TO RELATED APPLICATIONS

This application is a continuation application of U.S. application Ser. No. 15/150,359, filed May 9, 2016, which claims the benefit of U.S. provisional patent application Ser. No. 62/158,619, filed on May 8, 2015 and which is a continuation-in-part of U.S. patent application Ser. No. 14/647,264, filed on Nov. 29, 2013 and published as US 2015/0300100 A1 on Oct. 22, 2015, which is a US national phase application of PCT patent application Ser. No. PCT/CA2013/050919 filed on Nov. 29, 2013, and claims the benefit of U.S. provisional patent application Ser. No. 61/731,393 filed on Nov. 29, 2012, the above-listed applications being incorporated herein by reference in their entirety.

FIELD

Embodiments disclosed herein relate to apparatus for centralizing a tubular in a wellbore and more particularly, to centralizing a tubular drill string in a wellbore. Embodiments disclosed herein also relate to a method for replacing worn components/parts of the apparatus.

BACKGROUND

Centralizers are known for positioning tubulars, such as casing, drill pipes, rod strings and the like, within wellbores to minimize wear between the tubular and the wellbore walls in the case of an openhole application, or between the tubular and the casing walls in a cased wellbore, regardless the orientation of the wellbore. Without a centralizer, wear may be enhanced in horizontal wellbores particularly at the heel or deviated portion of the wellbore where directional changes would otherwise cause the tubular to engage the casing. Further, without a centralizer, grinding of the casing may occur when portions of the tubular, such as the drill pipe tool joints, are hard-faced with stiff material such as tungsten carbide. Efforts are made to make the hard-facing as smooth as possible so as to minimize the casing wear but since the drill pipe rotates it is inevitable that drill pipe tool joints will wear against the casing.

Generally, the centralizer engages the tubular and acts to space the tubular from either the wellbore walls or the casing. Casing centralizers are generally one piece and slide over the casing. Tubulars, such as drill pipe, have tool ends formed thereon and therefore drill pipe centralizers must be clamped over the tubular and secured thereon.

One such centralizer available from Hawkeye Industries Inc. of Edmonton, Alberta, Canada comprises a discontinuous, molded urethane, tubular body which is sufficiently flexible to be installed about a tubing string. The tubular body has molded fins extending radially outwardly therefrom to space the tubing string from the casing or wellbore walls. The centralizer is secured about the tubing string using a stainless steel band clamp. When the fins on the centralizer body have worn such that they no longer provide sufficient offset to space the tubular from the wellbore or casing walls, the centralizers are discarded and replaced.

Another tubing centralizer is available from Western Well Tool Ltd., of Houston Tex., USA. A tubular body of the centralizer comprises a plurality of hinged segments which are pinned together to encircle the tubular. Opposing end collars abut uphole and downhole ends of the tubular body for positioning the centralizer along a length of the tubular. The end or thrust collars, generally comprise two arcuate segments which are bolted together about the tubular to form the thrust collars. The thrust collars sandwich the tubular body therebetween in the axial direction. The bolts are typically high tensile steel bolts. Applicant understands that the hinged segments and the pins which connect the segments to form the body are prone to failure with repeated use. Failure of centralizers can be costly, particularly if portions of the centralizer fall into the wellbore and disrupt operations therein.

Yet another example of a prior art tubing centralizer is the RotoTEC® centralizer available from Tercel Oilfield Products, Dubai, UAE. The RotoTEC® centralizer comprises a freely rotating outer sleeve positioned over an internal pipe sleeve. The sleeves are made of a composite material such as a self-lubricating polymer with a low coefficient of friction and appear to comprise at least two "clamshell" halves which are pinned together in order to be positioned over the tubing. Upper and lower retaining clamps are bolted about the tubing string for retaining the sleeves thereon in the axial direction. When the outer sleeve is worn such that it no longer provides sufficient standoff to space the tubular from the wellbore or casing walls, at least the outer sleeve must be discarded and replaced.

In another aspect, there are competing objectives for centralizers in openholes and cased wellbore environments. While the centralizers must provide adequate standoff, centralizers running against casing are expected to minimize wear of the casing string. The nature of such centralizers is that the resilient nature thereof renders the softer portion of the centralizer vulnerable to wear and failure in openhole scenarios.

There is interest in the industry for a simple, efficient tubing centralizer and methodology for drilling that considers the environment for cased wellbores and open portion of horizontal wells.

SUMMARY

Embodiments disclosed herein are related to tubing centralizers and, more particularly, to drill pipe centralizers. The term tubular is used herein in a broad sense to mean a tubular pipe, drill pipe, tubular strings, a casing or the like. The tubular centralizers have a simple construction and have reduced number of connectors, thereby minimizing the risk of failure and setup/assembly time. The structure of the tubular centralizer is also such that it enables replacement of only the component contacting the wellbore or casing walls and deteriorated due to constant contact. End collars of the centralizer retain other components of the centralizer both radially and axially about the tubular.

Herein, two forms of centralizers are contemplated, both of which utilize a metal outer support body, a resilient inner sleeve and retaining end collars according to embodiments described herein. The form of the centralizer is matched with the wellbore environment. The centralizers have a metal or hard-faced metal protrusions for use in openhole wellbores and resilient protrusions for use in cased wellbores. In the horizontal well context, the openhole wellbore is typically the horizontal portion extending out of the cased portion from the heel portion to the end, usually called the toe section. Openhole is much more abrasive and destructive to centralizers than is the inside of the smooth casing. Centralizers quickly degrade when they exit the casing and end up in openhole. Further, the slip-slide nature of bent sub drilling operations exacerbates the damage to centralizers.

In drilling operations, one can extend the wellbore using resilient centralizers on the drill string to protect the previously cased portion of the wellbore at least until a new portion of the horizontal portion is drilled, One can coordinate a trip with a bit change, the drill string is tripped out and a downhole length of the drill string that will be exposed to the openhole is fit with metal centralizers and resilient centralizers for the portion of the drill string that is remaining, for the most part, in the casing. Of course, as one drills forward, some of the resilient centralizers in the casing will exit the cased portion and end up in the openhole and be subject to wear. However, significant operational advantages are realized with metal centralizers for that majority of the drill string portion that spends most of its moving in openhole.

Accordingly in one aspect there is provided a centralizer for installing about a joint of tubular within a wellbore. The centralizer comprises a resilient inner sleeve having a central bore formed therethrough for receiving the tubular therein and an outer surface. The centralizer further comprises a tubular outer support body having opposing end portions and a central bore formed therethrough for receiving the inner sleeve's outer surface. Three or more protruding members are spaced circumferentially about the centralizer and extend radially outwardly for spacing the tubular from the wellbore. The inner sleeve extends longitudinally beneath the support body. The centralizer further comprises a pair of annular end collars for retaining the support body and inner sleeve in the radial direction about the tubular and axially thereto. Each end collar has a collar bore for securing to the tubular and for securing to an opposing end portion of the support body.

In an embodiment, the three or more protruding members extend radially outwardly from the support body. The inner sleeve can extend contiguously under the support body between the end collars. The inner sleeve can further comprise three or more protruding resilient members corresponding with the three or more protruding members of the support body, providing radial support therefor. Each of the support body's protruding members have a radial tip for engaging the wellbore, each tip further comprising hardfacing thereon.

In another embodiment, the three or more protruding members are resilient members contiguous with and extending radially outwardly from the inner sleeve. Further, the support body has windows formed therein which correspond with the protruding members. When the inner sleeve is retained between the support body and the tubular, the protruding members project through the windows with the balance of the inner sleeve extending longitudinally beneath the support body.

In embodiments, the inner sleeve comprises two or more circumferentially arcuate inner sleeve segments retained about the tubular by the support body. In another embodiment, the inner sleeve comprises three or more arcuate inner sleeve segments retained about the tubular by the support body. Further, the support body can be provided as two or more support body segments and the two or more support body segments are retained about the inner sleeve by the end collars.

Accordingly in another aspect there is provided a centralizer for installing about a joint of tubular within a wellbore. The centralizer comprises a resilient inner sleeve having a central bore formed therethrough for receiving the tubular therein and an outer surface from which three or more protruding members extend radially outwardly. The three or more protruding members are spaced circumferentially about the inner sleeve for spacing the tubular from the wellbore. The centralizer further comprises a tubular outer support body having opposing end portions and a central bore formed therethrough for receiving the inner sleeve's outer surface. The support body has windows formed therein which correspond with the protruding members. When the inner sleeve is retained between the support body and the tubular, the protruding members project through the windows with the balance of the inner sleeve extending longitudinally beneath the support body. The centralizer further comprises a pair of annular end collars for retaining the outer body and inner sleeve in the radial direction about the tubular and axially thereto. Each end collar has a collar bore for securing to the tubular and for securing to an opposing end portion of the support body.

Accordingly in another aspect a method for removing and replacing worn components of a centralizer is provided. The centralizer comprises two or more arcuate inner sleeve segments retained about the tubular by two or more support body segments. The two or more support body segments are retained both axially and radially about the inner sleeve segments by the end collar. The method comprises disengaging at least one of the pair of end collars and removing at least one of the two or more support body segments for accessing the two or more inner sleeve segments having one or more worn protruding members. At least one inner sleeve segment with the worn protruding members is removed. Each of the removed inner sleeve segments is replaced with a replacement inner sleeve segment with its protruding members extending through corresponding support body windows of the at least one removed support body segment. The method further comprises re-installing the outer body segments and replacement inner sleeve segments about the tubular and securing the at least one end collar about opposing ends of the support body.

The inner sleeve and the support body may comprise multiple segments.

In one embodiment, the inner sleeve comprises two or more arcuate inner sleeve segments retained about the tubular by the support body.

In another embodiment, the inner sleeve comprises three or more arcuate inner sleeve segments retained about the tubular by the support body.

In another embodiment, the support body comprises two or more support body segments and the two or more support body segments are retained about the inner sleeve by the end collars.

In another embodiment, the inner sleeve comprises two or more arcuate inner sleeve segments and the support body comprises two or more support body segments. The two or more inner sleeve segments are retained about the tubular by the two or more support body segments. The two or more support body segments are retained about the inner sleeve by the end collars.

In another embodiment, the inner sleeve comprises three or more arcuate inner sleeve segments and the support body comprises two or more support body segments. The three or more inner sleeve segments are retained about the tubular by the two of more support body segments. The two or more support body segments are retained about the inner sleeve by the end collars.

In another embodiment, the inner sleeve comprises six arcuate inner sleeve segments spaced at about 60 degrees and the support body comprises two semi-circular support body segments forming six windows. The six inner sleeve segments are retained about the tubular by the two support body segments. The two support body segments are retained about the inner sleeve by the end collars.

According to one aspect of this disclosure, there is disclosed a system for drilling an openhole section from cased wellbore section. A drill string comprises resilient protrusion centralizer(s) on an uphole, cased section, and hard protrusion centralizer(s) on a downhole, uncased section.

In embodiments, use of resilient protrusion centralizer(s) and hard protrusion centralizer(s) may be adjusted during drill runs of the drill string.

For example, when drilling the vertical portion of a horizontal wellbore, no centralizer is used. When the drilling transits to horizontal drilling, and the drilled wellbore portion is cased, the drill string trips out, and is fit with resilient protrusion centralizer(s), for the casing portion, and hard protrusion centralizer(s) downhole to the resilient protrusion centralizer(s), for the openhole or uncased portion. The drill string may trip out a plurality of times during drilling operation, and in at least some drill string trip-out, at least some resilient protrusion centralizer(s) may be replaced with hard protrusion centralizer(s).

According to one aspect of this disclosure, there is disclosed three types of centralizers, including a resilient protrusion centralizer having one or more resilient protrusions each having a resilient surface, a hard protrusion centralizer having one or more hard protrusions each having a hard or stiff surface, and a centralizer having both resilient and hard protrusions (denoted as resilient/hard protrusion centralizer). In use, a drill string may be fit with all, or any two types of, the three types of centralizers such that, except for a transitional wellbore portion between the casing portion and uncased or openhole portion thereof, the casing portion is faced with resilient protrusion surface(s), and the openhole portion is faced with hard protrusion surface(s). In the transitional portion, which may comprise a portion of casing uphole and a portion of uncased wellbore downhole, one may use centralizer(s) having resilient surface(s), being resilient protrusion centralizer(s) and/or resilient/hard protrusion centralizer(s). The centralizers in the transitional portion, when entering the openhole portion, face wear to the resilient protrusion(s). If resilient protrusion centralizer(s) are used, the resilient protrusion centralizer(s) may be worn out or damaged, and later replaced when the drill string is pulled out of hole for service. If resilient/hard protrusion centralizer(s) are used, the resilient protrusion(s) may be worn out, exposing hard protrusion(s) for contacting the wall of the uncased wellbore.

According to one aspect of this disclosure, there is disclosed a method of drilling a wellbore using a drill string having centralizer(s) having resilient protrusion surface(s) in an uphole, casing portion of a wellbore, and having centralizer(s) having hard protrusion surface(s) in a downhole, uncased portion of the wellbore.

In one embodiment, all centralizers are initially those having resilient protrusion surface(s). At each of at least some of drill string tripping out, one or more centralizers at a downhole side of the drill string are replaced with those having hard protrusion surface(s). Centralizers having resilient protrusion surface(s) are fit to an uphole side of the drill string as needed.

In another embodiment, the drill string in an uphole, casing portion is fit with centralizer(s) having resilient protrusion surface(s). The drill string in a downhole, uncased portion is fit with centralizer(s) having hard protrusion surface(s). The drill string in a transition portion between the uphole, casing portion and the downhole, uncased portion is fit with resilient/hard protrusion centralizer(s).

In another embodiment, the drill string is fit with resilient/hard protrusion centralizer(s) only. In the casing portion of a wellbore, the resilient surface(s) of the centralizer(s) protect the casing from damage. The resilient surface(s) of the centralizer(s) moving into the uncased portion of the wellbore may be worn out, and expose the hard surface(s).

In practice, the Inner Diameter (ID) of the casing is usually slightly larger than that of the uncased wellbore portion. According to one aspect of this disclosure, the resilient protrusion(s) are adapted to (but slightly smaller than) the Inner Diameter (ID) of the casing, and the hard protrusion(s) are adapted to (but slightly smaller than) that of the uncased wellbore portion.

According to one aspect of this disclosure, there is disclosed centralizer for installing about a tubular. The centralizer comprises: a resilient inner sleeve for circumferentially about the tubular, the inner sleeves forming opposing axial ends and a central bore adapted for slidably receiving the tubular; a tubular outer support body about the inner sleeves, the support bodies forming opposing axial ends and a body central bore for receiving the inner sleeve; one or more protrusions radially extending from the outer support body for engaging the wall of a wellbore, and for spacing the tubular from the wellbore; and a pair of annular end collars configured to rotationally retain the tubular at opposing axial ends of the support body for preventing axial and radial movement of the support body therebetween.

In some embodiments, each of the one or more protrusions has a resilient surface.

In some embodiments, each inner sleeve segment further comprises at least one protruding member extending radially outwardly from an outer surface thereof for forming the one or more protrusions; and each support body segment further comprises at least one window formed therein for one of the at least one protruding member to extend therethrough.

In some embodiments, the protruding members and the windows are formed generally longitudinal therealong.

In some embodiments, each of the one or more protrusions has a wear-resistant surface.

In some embodiments, at least a portion of the support body extends radially outwardly, forming the one or more protrusions.

In some embodiments, the one or more protrusions are further covered by a layer of stiff material.

In some embodiments, the stiff material is tungsten carbide.

In some embodiments, at least one of the one or more protrusions is covered by a resilient layer.

In some embodiments, the support body is made of metal such as steel.

In some embodiments, the inner sleeve is made of a polymer.

In some embodiments, the inner sleeve is made of polyurethane.

According to one aspect of this disclosure, there is provided a method for drilling a wellbore. The method comprises: coupling one or more centralizers of claim 2 on a drill string, said drill string have a drilling bit at a distal end; drilling a portion of the wellbore using said drill string; pulling said drill string out of hole; casing at least a section of the drilled wellbore; replacing, from said distal end, at least one of the one or more centralizers with one or more above-described centralizers; and drilling a further portion of the wellbore using said drill string.

According to one aspect of this disclosure, there is provided a system for drilling an openhole wellbore from a cased wellbore. The system comprises: a drill string having an uphole portion and a downhole portion; a plurality of resilient centralizers having resilient protrusions, the resilient centralizers fit to at least a portion of the uphole portion; and a plurality of wear-resistant centralizers having hard protrusions, the wear resistant centralizers fit to at least a portion of the downhole portion; wherein, as the downhole portion of the drill string advances in a drilling run from the cased wellbore to drill in the openhole wellbore, the wear-resistant centralizers engage the openhole wellbore and the resilient centralizers engage the cased wellbore.

In some embodiments, the cased wellbore includes a deviated portion, and wherein said at least a portion of the uphole portion fit with resilient centralizers is the deviated portion.

In some embodiments, the uphole portion remains in the cased wellbore for the entire drilling run.

In some embodiments, the deviated portion is an angle build portion.

In some embodiments, the drill string further comprises a transition portion intermediate the uphole and downhole portions, the transition portion fit with transition centralizers having a first resilient protrusions and second hard protrusions, the first resilient protrusions having a greater radial extent than the second hard protrusions, the downhole portion and a portion of the transition portion of the drill string advance from the cased portion to drill in the openhole wellbore, some of the transition centralizers engage the open hole and some remain in the cased wellbore.

In some embodiments, the resilient centralizers remain in the cased wellbore during the drilling run.

In some embodiments, the resilient centralizers are transition centralizers, the first resilient protrusions engaging the cased wellbore; the wear resistant centralizers are transition centralizers, the first resilient protrusions being sacrificial for engaging the second hard protrusions with the openhole wellbore.

According to one aspect of this disclosure, there is provided a method of drilling an open hole wellbore from a cased wellbore. The method comprises: advancing a drill string along the wellbore in a drilling run from the cased wellbore and into the openhole wellbore; centralizing at least a portion of an uphole portion of the drill string in the cased wellbore with resilient centralizers having resilient protrusions; and centralizing at least a portion of a downhole portion of the drill string in the openhole wellbore with wear resistant centralizers having hard protrusions.

In some embodiments, the cased wellbore includes a deviated wellbore further comprising centralizing the uphole portion of the drill string in the deviated wellbore.

In some embodiments, the method further comprises: fitting the uphole portion of the drill string with the resilient centralizers; fitting a transition portion of the drill string, intermediate the uphole and downhole portions, with transition centralizers having a first resilient protrusions and second hard protrusions, the first resilient protrusions having a greater radial extent than the second hard protrusions; advancing the downhole portion of the drill string in a drilling run along the openhole wellbore; centralizing the drill string in the openhole wellbore with the hard centralizers; advancing at least a portion of the transition portion of the drill string into the openhole wellbore; sizing the radial extent of the first resilient protrusions of the transition centralizers against the openhole wellbore; and continuing to centralize the at least a portion of the transition portion in the openhole wellbore with the second hard protrusions.

According to one aspect of this disclosure, there is provided a dual-gauge centralizer for installing about a tubular. The centralizer comprises: a resilient inner sleeve fit circumferentially about the tubular, the inner sleeve forming opposing axial ends and a central bore adapted for slidably receiving the tubular; a tubular outer support body, the support body forming opposing axial ends and a body central bore for receiving the inner sleeve; a first set of protrusions extending radially from the outer support body to a first radial extent, the first set of protrusions being resilient and spacing the tubular from the wellbore; a second set of protrusions extending radially from the outer support body to a second radial extent smaller than the first radial extent, the second set of protrusions being wear resistant; and a pair of annular end collars configured to secure to the tubular at opposing axial ends of the support body for axially and radially retaining the tubular support body to the tubular.

In some embodiments, the first set and second sets of protrusions are circumferentially alternately distributed.

In some embodiments, at least a portion of the first set of protrusions are wear-resistant protrusions covered by a resilient layer.

In some embodiments, at least a portion of the first set of protrusions are formed by extending the resilient inner sleeve radially outwardly through ports on the tubular outer support body.

According to one aspect of this disclosure, there is disclosed a method of drilling a wellbore using a drill string having centralizers. The wellbore comprises an uphole, cased portion and a downhole, uncased portion. Centralizer(s) having resilient protrusion surface(s) are used for contacting the casing of the cased portion for centralizing the drill string therein, and centralizer(s) having hard protrusion surface(s) are used for contacting the wall of the uncased portion for centralizing the drill string therein.

In some embodiments, the resilient protrusion surface(s) may be sacrificed to expose hard protrusion surface(s).

In particular, a centralizer may comprise resilient protrusion surface(s) and hard protrusion surface(s) covered thereunder. In use, the resilient protrusion surface(s) may be worn out or sacrificed to activate hard protrusion surface(s) covered thereunder.

Alternatively, a centralizer may comprise one or more protrusions with resilient protrusion surface(s) and one or more protrusions with hard protrusion surface(s). The protrusions with resilient protrusion surface(s) have greater radial extent than those with hard protrusion surface(s). In use, the resilient protrusion surface(s) may be worn out or sacrificed to reduce the radial extent thereof, and activate hard protrusion surface(s).

BRIEF DESCRIPTION OF DRAWINGS

FIG. 9A shows the tubular supported in the inner sleeve of the resilient-protrusion centralizer, and FIG. 9B is shown absent the tubular for illustrating the interface of the inner sleeve and support body in the end collar;

FIG. 16A shows the drill string fit with resilient-protrusion centralizers, some of which have moved into the openhole horizontal section;

FIG. 16B shows the drill string having been tripped out for bit maintenance and a centralizer change; and FIG. 16C shows the drilling operation continuing to extend the openhole portion, the string fit with a combination of resilient-protrusion and hard-protrusion centralizers, the distal end of the string in the openhole fit primarily with hard-protrusion centralizers and the drill string remaining in the cased portion of the wellbore fit with resilient-protrusion centralizers;

DETAILED DESCRIPTION

Figure 1:
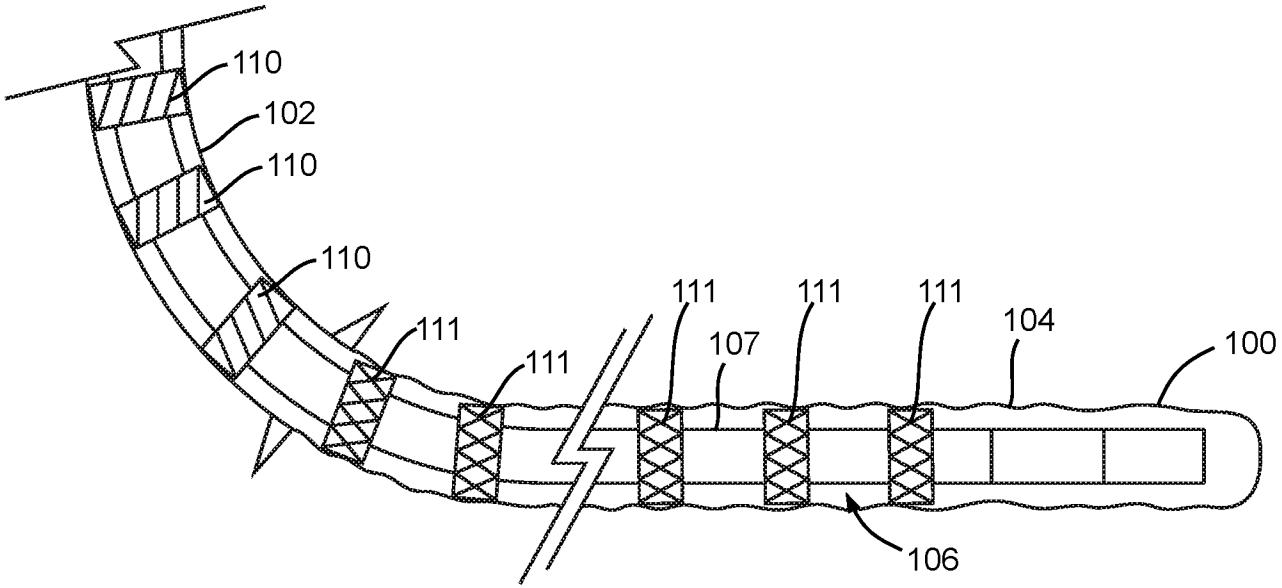
FIG. 1 is a schematic side view of a wellbore during a drilling operation using centralizers, bent sub, and a drilling bit and a mud motor at a distal end thereof, the drilling operation continuing out of the cased wellbore portion and into an openhole horizontal section; the drill string fit with resilient-protrusion and hard-protrusion centralizers.

The hard-protrusion and resilient-protrusion centralizer embodiments herein are an assembly of parts which result in a rugged construction with the ability to assemble loose shell components that do not have hinges, pins or bands to hold them together. The tubular string is used as one of the major structural components in the assembly.

Generally, embodiments of the centralizers disclosed herein implement circumferential segments of a resilient inner sleeve that are assembled about and bear against the tubular drill string. The inner sleeve segments are retained to the tubular by circumferential segments of an outer support body. The inner sleeve and support body segments are retained to the tubular by end collars that overlap uphole and downhole overlapping ends of the inner sleeves and support body segments. The segments of the inner sleeve and the support body are assembled about the tubular in their unconnected form and secured thereto using annular end collars for preventing axial and radial movement of these segments.

Accordingly the centralizers are installed about a joint of tubular within a wellbore. The centralizer comprises a resilient inner sleeve having a central bore formed therethrough for receiving the tubular therein and an outer surface. The centralizer further comprises a tubular outer support body having opposing end portions and a central bore formed therethrough for receiving the inner sleeve's outer surface. Three or more protruding members are spaced circumferentially about the centralizer and extend radially outwardly for spacing the tubular from the wellbore. The inner sleeve extends longitudinally beneath the support body. The centralizer further comprises a pair of annular end collars for retaining the support body and inner sleeve in the radial direction about the tubular and axially thereto. Each end collar has a collar bore for securing to the tubular and for securing to an opposing end portion of the support body.

In an embodiment, the three or more protruding members extend radially outwardly from the support body. The inner sleeve can extend contiguously under the support body between the end collars. The inner sleeve can further comprise three or more protruding resilient members corresponding with the three or more protruding members of the support body, providing radial support therefor. Each of the support body's protruding members have a radial tip for engaging the wellbore, each tip further comprising hard-facing thereon.

In another embodiment, the three or more protruding members are resilient members contiguous with each other and extending radially outwardly from the inner sleeve. Further, the support body has windows formed therein which correspond with the protruding members. When the inner sleeve is retained between the support body and the tubular, the protruding members project through the windows with the balance of the inner sleeve extending longitudinally beneath the support body.

In embodiments, the inner sleeve comprises two or more circumferentially arcuate inner sleeve segments retained about the tubular by the support body. In another embodiment, the inner sleeve comprises three or more arcuate inner sleeve segments retained about the tubular by the support body. Further, the support body can be provided as two or more support body segments and the two or more support body segments are retained about the inner sleeve by the end collars.

As will be described in more detail below, the protruding members for engaging the wall of the wellbore may be resilient protrusions or hard protrusions in various embodiments. Generally the inner sleeve and support body approach is applicable for both hard and resilient implementations.

Horizontal drilling has placed greater demands on centralizers than ever before. Centralizers support a larger share of the drill string weight along the horizontal portions while also being subjected to the forces during slip-slide drilling techniques. Herein, two forms of robust centralizers are disclosed, both of which utilize a metal outer support body, a resilient inner sleeve and retaining end collars according to embodiments described herein. As shown in FIGS. 1A to 1C, the form of centralizer is matched with the wellbore environment, having a metal or hard-faced metal protrusions for openhole wellbore (FIGS. 2 to 5), and/or having resilient protrusions for cased wellbore (FIGS. 6, 7 and 8A-15B).

In the horizontal well context, the openhole wellbore is typically the horizontal portion extending out of the cased portion from the heel to the end, usually called the toe section. Openhole is much more abrasive and destructive to centralizers than is inside the smooth casing. Centralizers quickly degrade when they exit the casing and end up in openhole.

Drill String with Resilient-Protrusion and Hard-Protrusion Centralizers

With reference to FIG. 1, a wellbore 100 in drilling operation using a drill string 106 having one or more drilling pipes 107 is shown. Similar to the wellbores known in the art, the wellbore 100 starts from a vertical wellbore portion and transits to a horizontal portion via a so-called "heel", also denoted as a deviated portion or deviated wellbore hereinafter. In some embodiments, the deviated portion or deviated wellbore is an angle build portion, and may also more generally refer to a wellbore section that changes direction.

In this embodiment, the wellbore 100 comprises a casing portion 102, also denoted as cased portion or cased wellbore hereinafter. The casing portion 102 in this embodiment includes the heel or deviated portion. The wellbore 100 also comprises an openhole portion 104, also denoted as uncased portion or openhole wellbore hereinafter.

Correspondingly, the drill string 106 comprises one or more resilient-protrusion centralizers 110, also denoted as resilient centralizers hereinafter, spaced therealong in the cased portion 102 to centralize the drill pipe 107 therein, and in particular to centralize the drill pipe 107 in the deviated portion. The drill string 106 also comprises one or more hard-protrusion centralizers 111, also denoted as hard centralizers or wear-resistant centralizers hereinafter, spaced therealong in the openhole portion 104 to centralize the drill pipe 107 therein. Herein, the resilient-protrusion centralizers 110 comprise resilient protrusions each having a resilient surface for engaging the wall of the wellbore 100, for protecting the casing or liner of the cased portion 102 from wearing as the drill string advances therethrough. The hard-protrusion centralizers 111 comprise stiff or wear-resistant protrusions each having a stiff or wear-resistant surface for engaging the wall of the wellbore 100. The hard-protrusion centralizers 111 are more suitable for adapting to the abrasive wall of the openhole wellbore portion 104.

During drilling operation, the drill pipe 107 rotates inside the centralizers 110 and 111. On the other hand, the centralizers 110 and 110 typically are not rotating against the casing 102 and uncased well bore 104. However, with the progress of the drilling operation, the centralizers 110 and 111 slide downhole with the advancing of the drilling pipe 107. The centralizers 110 and 111 slide uphole when the drill string 106 is pull out of hole for service.

Resilient-Protrusion Centralizers

Figure 2A:
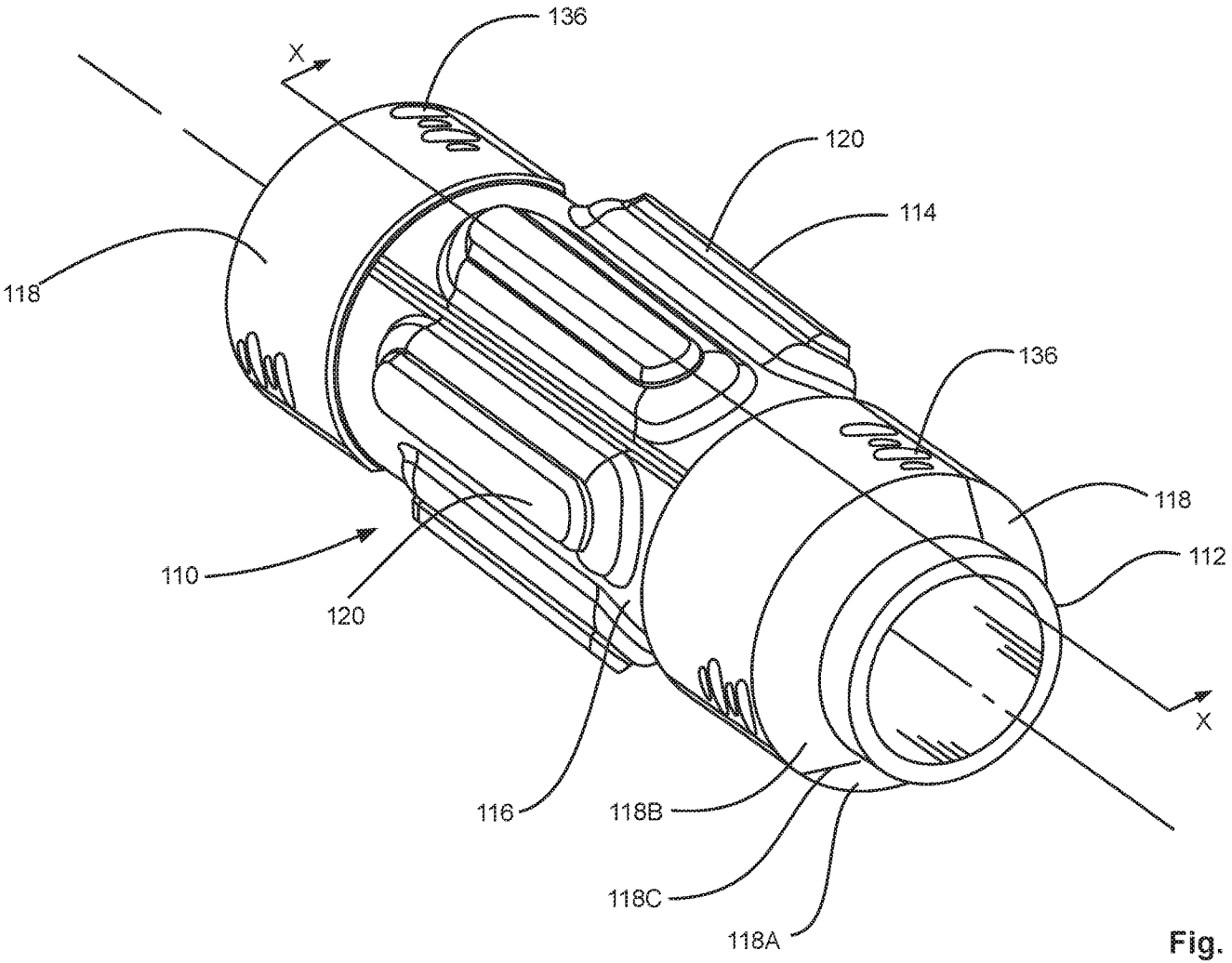
FIG. 2A is a perspective view of a resilient-protrusion centralizer according to an embodiment disclosed herein and shown installed on a section of tubular.
Figure 2B:
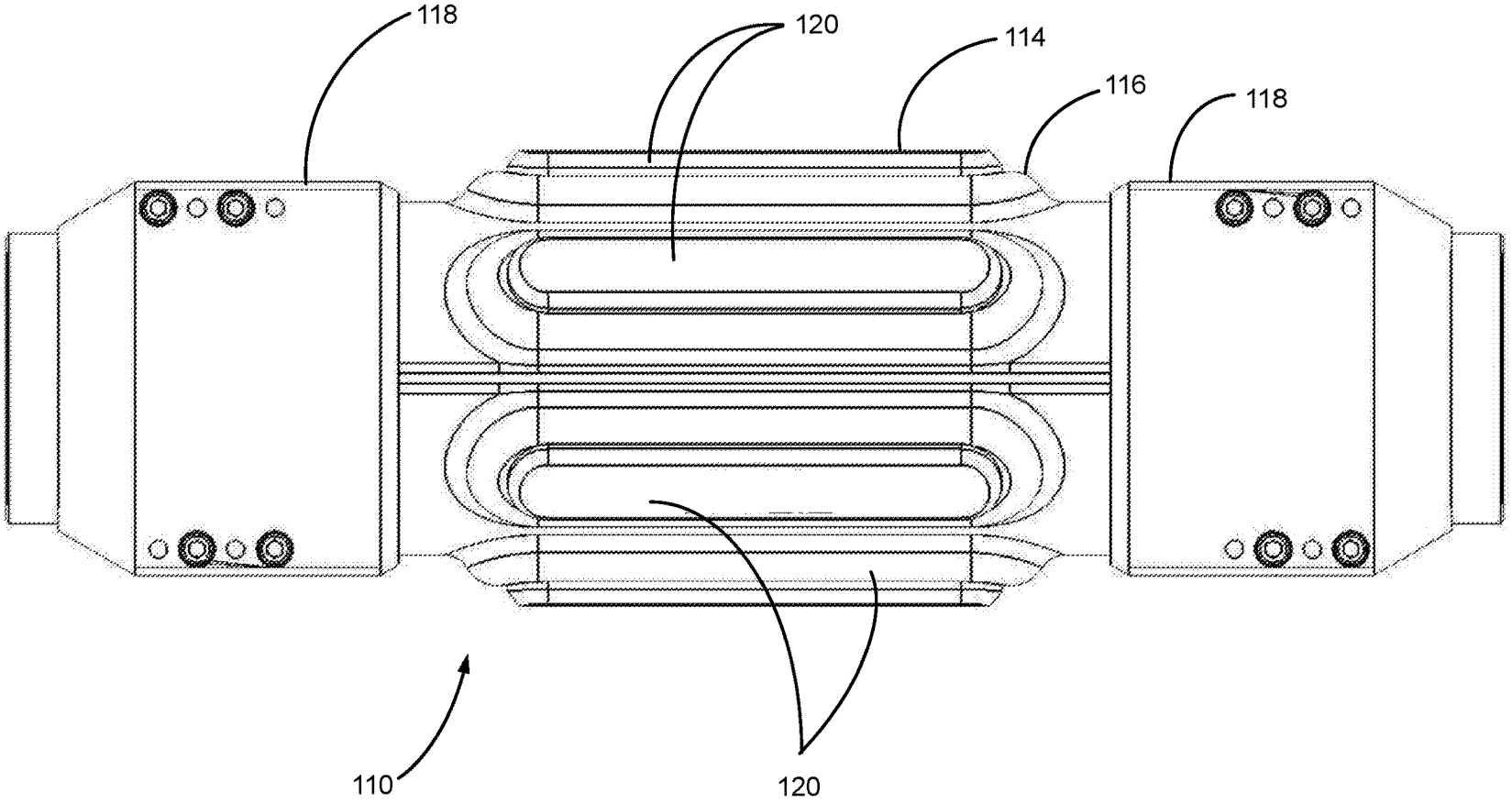
FIG. 2B is a side view of the resilient-protrusion centralizer of FIG. 2A.
Figure 2C:
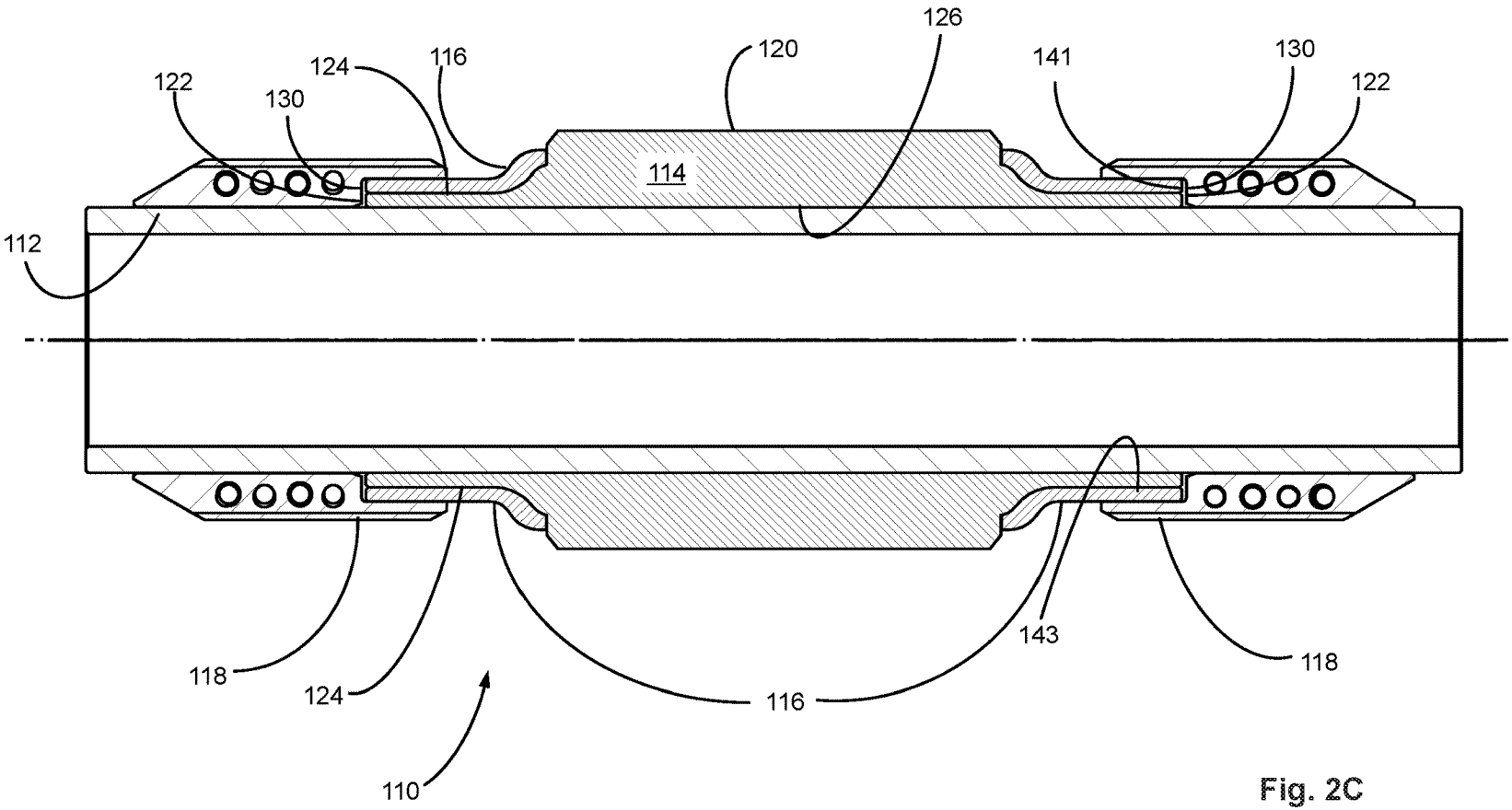
FIG. 2C is a side cross-sectional view of the resilient-protrusion centralizer of FIG. 2A along line X-X.

FIGS. 2A to 2C show greater details of the resilient-protrusion centralizer 110 according to one embodiment. As shown in FIG. 2A, a centralizer 110 is shown installed on a section or joint of a tubular 112 such as the drill pipe 107, which may be a part of the drill string 106. The centralizer 110 comprises a resilient inner sleeve 114 for supporting the tubular 112 from the wellbore such as casing or other tubular string. The centralizer 110 further comprises a tubular outer support body 116, sandwiching the inner sleeve 114 between the support body 116 and the tubular 112. Despite being fit with an outer support body 116, the inner sleeve 114 protrudes therethrough, forming a plurality of circumferentially spaced protruding members 120 for engaging the wellbore (not shown), and centralizing and spacing both the tubular 112 and the support body 116 therefrom. Preferably, the inner sleeve 114 is made of a polymer such as polyurethane for minimizing damage to the inside of the casing or wellbore on one side and particularly to the tubular on the other side. In this embodiment, inner sleeve 114 serves as a sacrificial component for periodic replacement.

With reference to FIGS. 2B and 2C, the inner sleeve 114 comprises three or more circumferentially spaced protruding members 120 formed generally longitudinally along the inner sleeve between opposing ends 122, 122 of the inner sleeve 114.

The support body 116 is more robust, generally being manufactured of metal such as steel. Thus, both the tubular 112 and the wellbore side walls are contacted by a softer resilient material, and contact with the hard support body 116 is avoided or at least minimized. The support body 116 retains the inner sleeve 114 in the radial direction and circumferentially about the tubular 112. The hard support body 116 further also protects the softer inner sleeve 114. The inner sleeve 114 and the support body 116 are retained both axially along and radially about the tubular 112 using a pair of bookend end collars 118, 118. The end collars 118, 118, in addition to retaining the inner sleeve 114 and support body 116 on the tubular 112, also axially position the support body 116 and the inner sleeve 114 along the tubular 112.

The disclosed inner sleeve 114 may be of a single piece construction with a split for resilient installation about the tubular, or may comprise multiple segments that cooperate as a circumferential array about the tubular 112. For ease of assembly about the tubular 112, the inner sleeve 114 and the support body 116 are formed of at least two segments. The description and drawings describe and illustrate the inner sleeve 114 and support body 116 as comprising at least two segments, however, it is to be understood that the disclosure is not so limited.

Figure 3A:
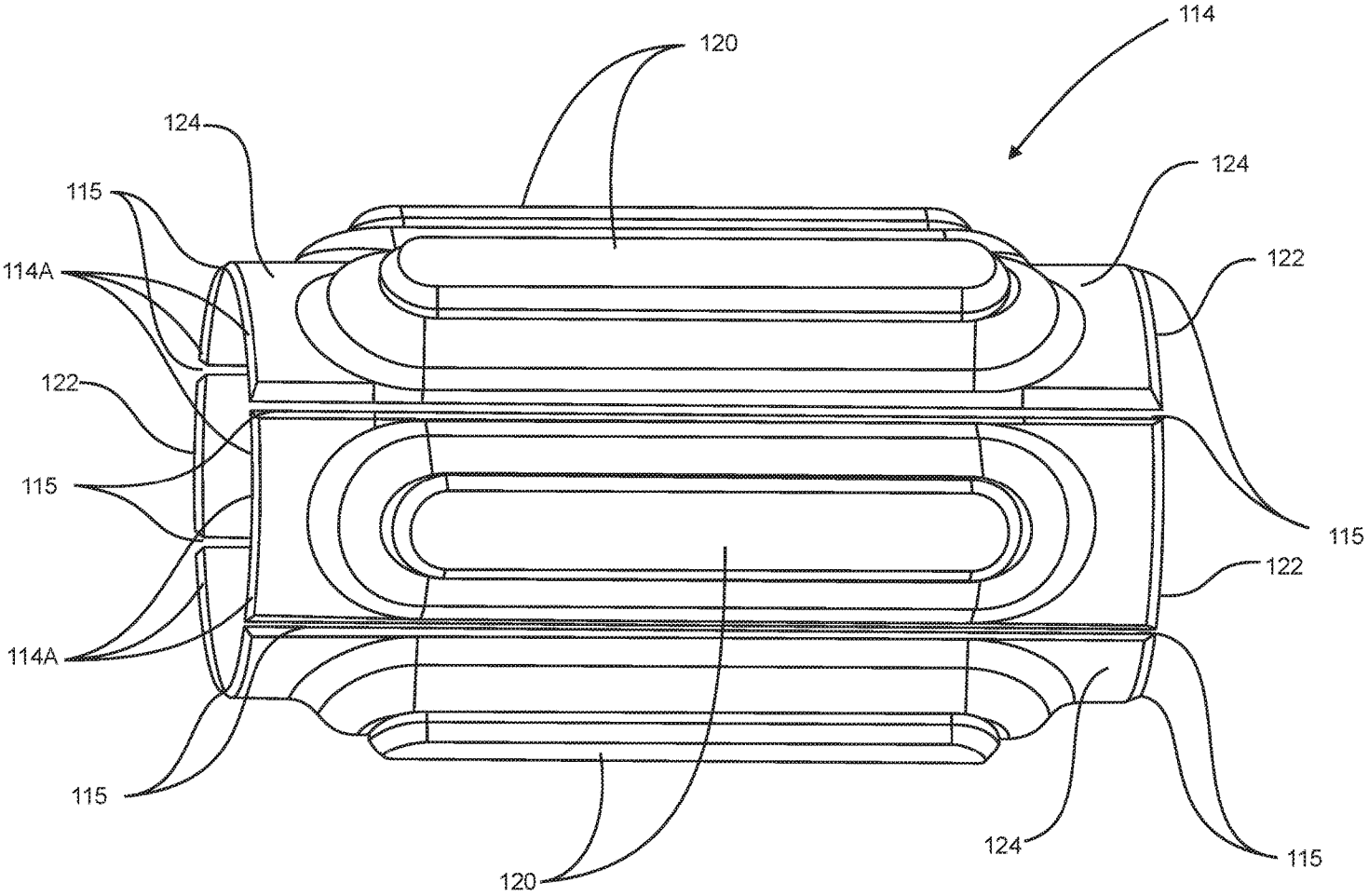
FIG. 3A is a perspective side view of six inner sleeve segments of the resilient-protrusion centralizer of FIG. 2A, each inner sleeve segment having one protruding member for a total of six when assembled.

With reference to FIG. 3A, an inner sleeve 114 formed of six arcuate inner sleeve segments 114A spaced at about 60 degrees is illustrated. Each inner sleeve segment 114A comprises at least one of the protruding members 120. The protruding member 120 extends radially outwardly from an outer surface 124 of the inner sleeve segment 114A. The multiple inner sleeve segments 114A are arranged circumferentially in a radial array about the tubular 112 and abut each other along longitudinal edges 115 to form the inner sleeve 114. The inner sleeve 114 forms a central bore 126. The tubular 112 is longitudinally supported in the central bore 126. The inner sleeve segments 114A and the protruding members 120 thereon are configured such that, when assembled, protruding members 120 are evenly and circumferentially spaced about the inner sleeve 114 and tubular 112.

Figure 3B:
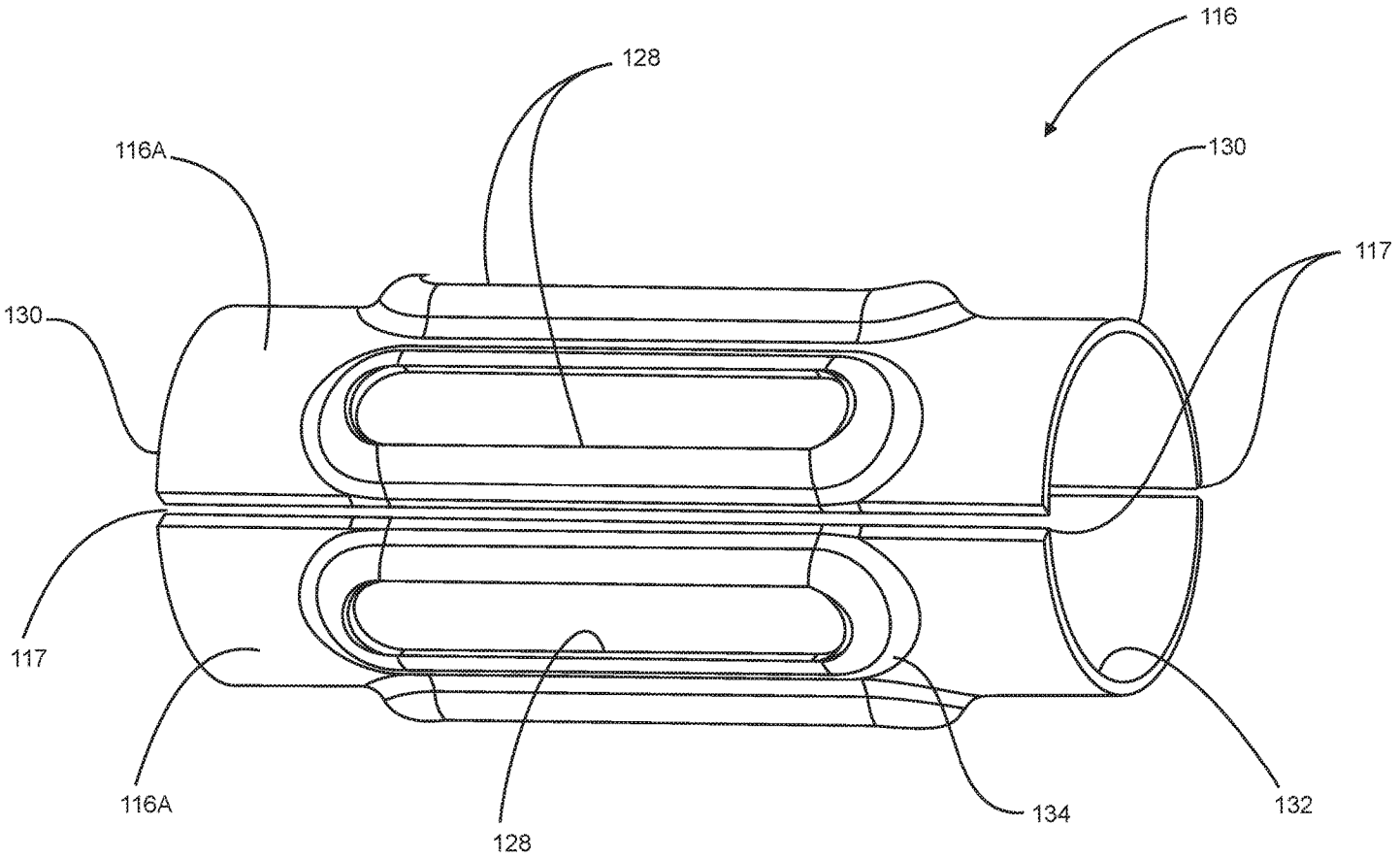
FIG. 3B is a perspective side view of two semi-circular support body segments of the resilient-protrusion centralizer of FIG. 2A, each support body segment having three windows for receiving the protruding members of three inner sleeve segments when assembled.

FIG. 3B illustrates a support body 116 generally formed of two or more support body segments 116A for ease of installation. In one embodiment, the support body 116 is formed of two, semi-circular support body segments 116A, 116A. As shown, each support body segment 116A is configured to house three inner sleeve segments 114A, 114A, 114A of FIG. 3A. Accordingly, each support body segment 116A comprises three windows 128 formed generally lengthwise between opposing end portions 130, 130 of the support body 116. When arranged circumferentially, the two support body segments abut each other along longitudinal edges 117 forming a central bore 132. The support body's bore 132 retains the outer surface 124 of the inner sleeve 114. Each window 128 is supported within a longitudinal buttress 134 about a perimeter of the window 128. The support body segments 116A, the windows 128 and the buttresses 134 are configured such that when the support body segments 116A are arranged circumferentially, the windows 128 and the buttresses 134 are evenly spaced about the support body 116, corresponding to the arrangement of the protruding members 120.

The protruding members 120 and the windows 128 are complementary to each other and align during assembly. The windows 128 are sized and shaped to receive the protruding members 120 during assembly.

Depending upon the number of inner sleeve segments, and protruding members per inner sleeve segment 114A, and the number of support body segments 116A and corresponding windows 128 formed therein, the inner sleeve segments 114A may need to installed into the support body 116 before assembly to the tubular 112 or, in other instances, typically with a large number of segments 114A, 116A, one can assemble the support body segments to inner sleeve segments already arranged about the tubular 112. The resilience of the inner sleeve can aid in manipulating the protruding members 120 through corresponding windows 128.

Figure 3D:
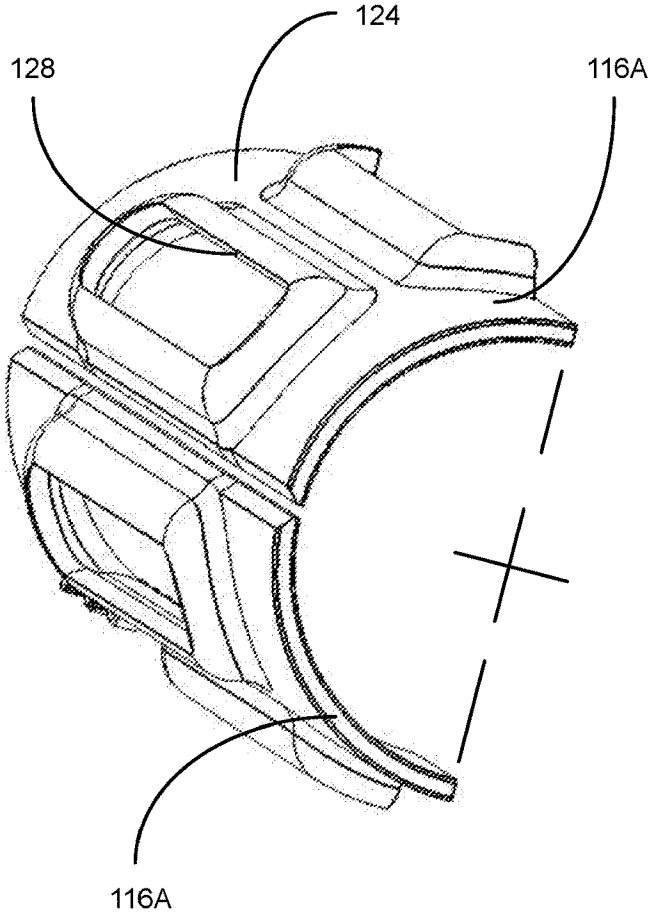
FIG. 3D is a perspective side view of a half section of each of two of semi-circular support body segments of the resilient-protrusion centralizer of FIG. 2A, each support body having three windows for receiving combined three protruding members from two inner sleeve segments of FIG. 3A.
Figure 3C:
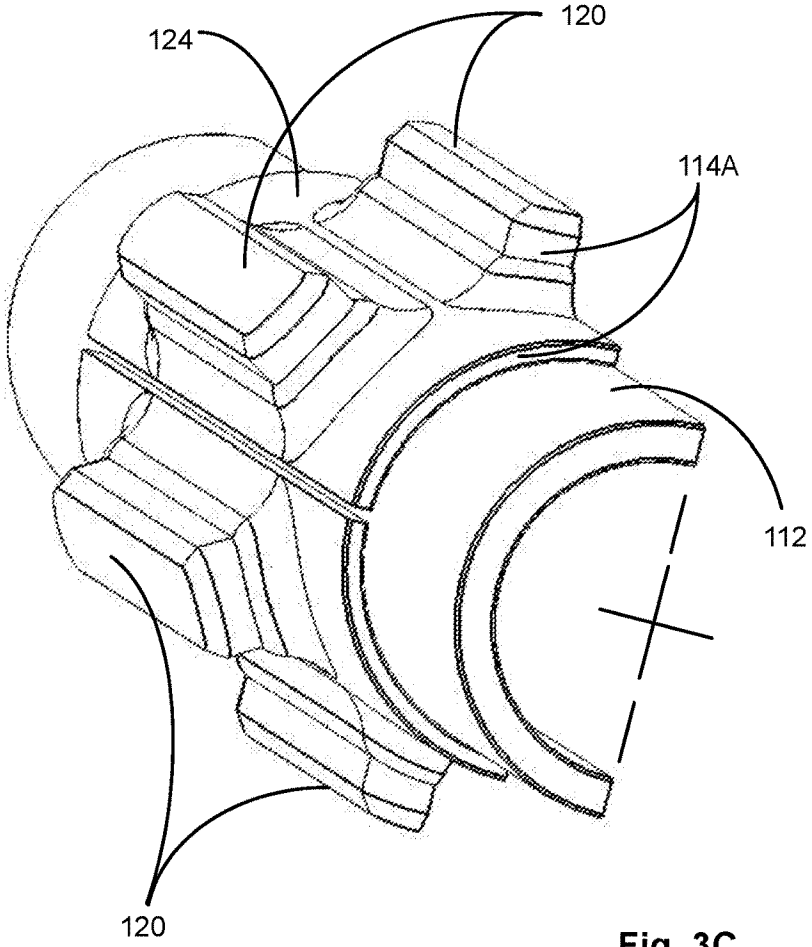
FIG. 3C is a perspective side view of two of four inner sleeve segments arranged on a tubular of the resilient-protrusion centralizer of FIG. 2A, each inner sleeve segment having one and one-half protruding members for a total of six when assembled.

As shown in FIG. 3C, a tubular 112 is shown fit with two of four inner sleeve segments 114A. In FIG. 3D, two quadrants of two support body segments 116A are shown in corresponding orientation for installation to the inner sleeve segments 114A.

Figure 4A:
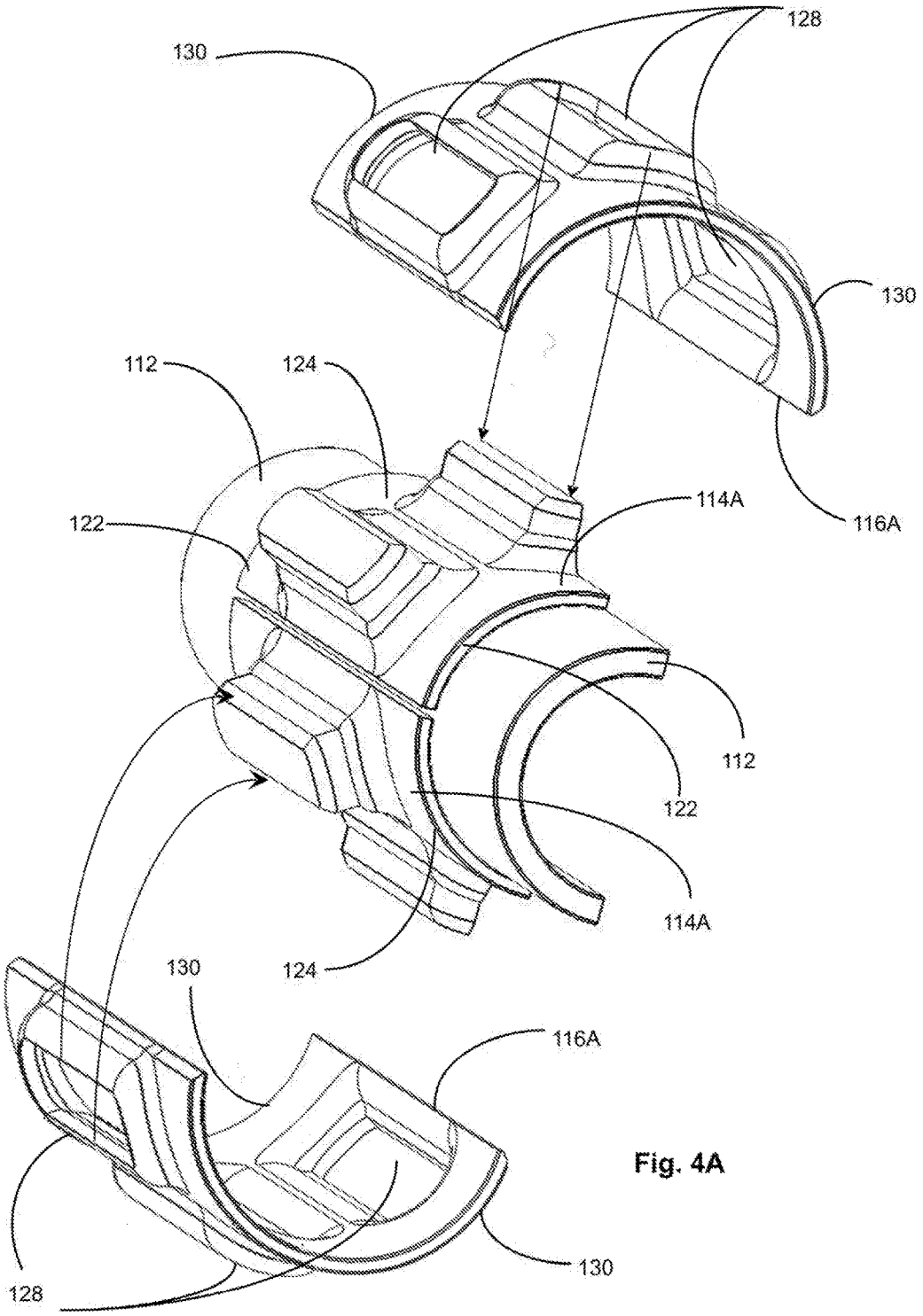
FIG. 4A is a perspective exploded view of two semi-circular support body segments each for installation over two inner sleeve segments of the resilient-protrusion centralizer of FIG. 2A, each inner sleeve segment having one and one-half protruding members.

With reference to FIG. 4A, the arrangement of FIGS. 3C and 3D is in relative location such as for assembly. In this arrangement it is likely that two inner sleeve segments 114A, 114A, having one and one-half protruding members 120 per segment would need to be pre-installed into the three-window 128 support body segments 116A. A first semi-circular support body segment 116A is aligned with two 90 degrees inner sleeve segments 114A, 114A (only one of two are shown in this section) and a second semi-circular support body segment 116A is aligned with another two 90 degrees inner sleeve segments 114A, 114A.

Figure 4B:
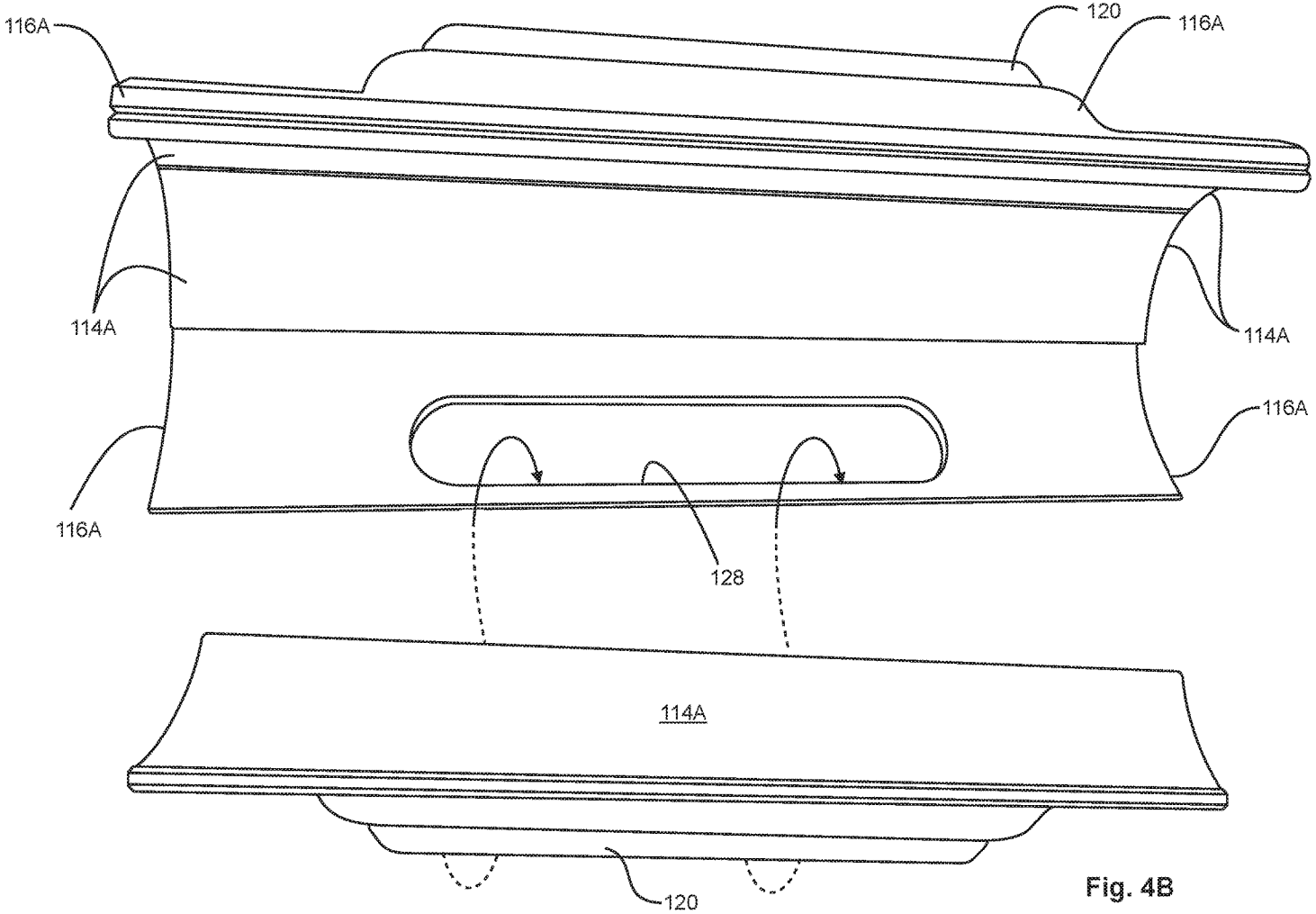
FIG. 4B is a perspective view of one semi-circular support body segment for three protruding members and having two inner sleeve segments fit thereto and one of the inner sleeve segments shown displaced or removed to the side to illustrate its corresponding remaining window in the support body segment.

With reference to FIG. 4B, one semi-circular support body segment 116A is preloaded with two of three inner sleeve segments 114A, the protruding members 120 extending through their respective windows 128. This embodiment is similar to that shown in FIGS. 3A and 3B. One inner sleeve segment 114A is shown displaced with installation arrows indicating its form of installation with the protruding member 120 extending into the remaining available window 128.

Figure 5:
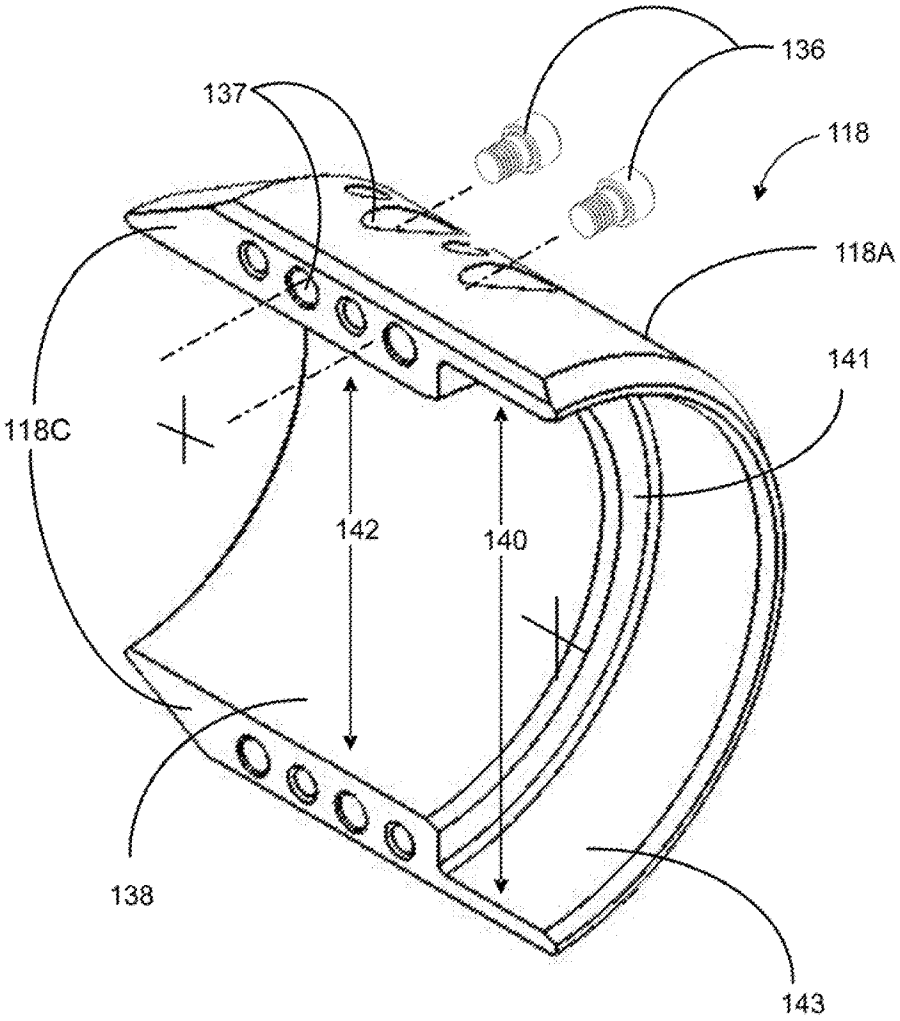
FIG. 5 is a perspective side cross-sectional view of an annular end collar of the resilient-protrusion centralizer of FIG. 2A.

Having reference to FIG. 5, each annular bookend end collar 118 is formed as two semi-circular clamshell segments or halves 118A and 118B which are connected together at connecting edges 118C. When coupled, the end caps 118, 118 retain both the support body 116 and inner sleeve 114 to the tubular 112. The end caps are assembled using fasteners such as at least two high tensile steel bolts or cap screws 136, at opposing tangential connectors, spanning across the connecting edge 118C. This is similar to the connection arrangement discussed in the prior art. Generally, the fasteners 136 extend transverse to the longitudinal axis of the centralizer 110, each bolt 136 being installed in an opposing direction to a longitudinally adjacent fastener 136 through a corresponding bolt hole 137. As one of skill in the art will appreciate, the more fasteners 136 which can be used the stronger the connection. The number of fasteners 136 which can be used is generally limited by the axial length of the end collars 118 and practically, by the overall axial length of the support body 116.

Each end collar 118 comprises a collar bore 138 formed longitudinally or lengthwise therethrough. The bore 138 has a first diameter section 140 corresponding to a diameter of the ends 130, 130 of the support body 116, and a second diameter section 142 corresponding to a diameter of the tubular 112. The step in diameter sections 140, 142 forms a stop shoulder 141 and the first diameter section 140 forms an annular overlapping portion 143. The second diameter section is a clamping bore portion and is smaller than the first diameter section.

Figure 6:
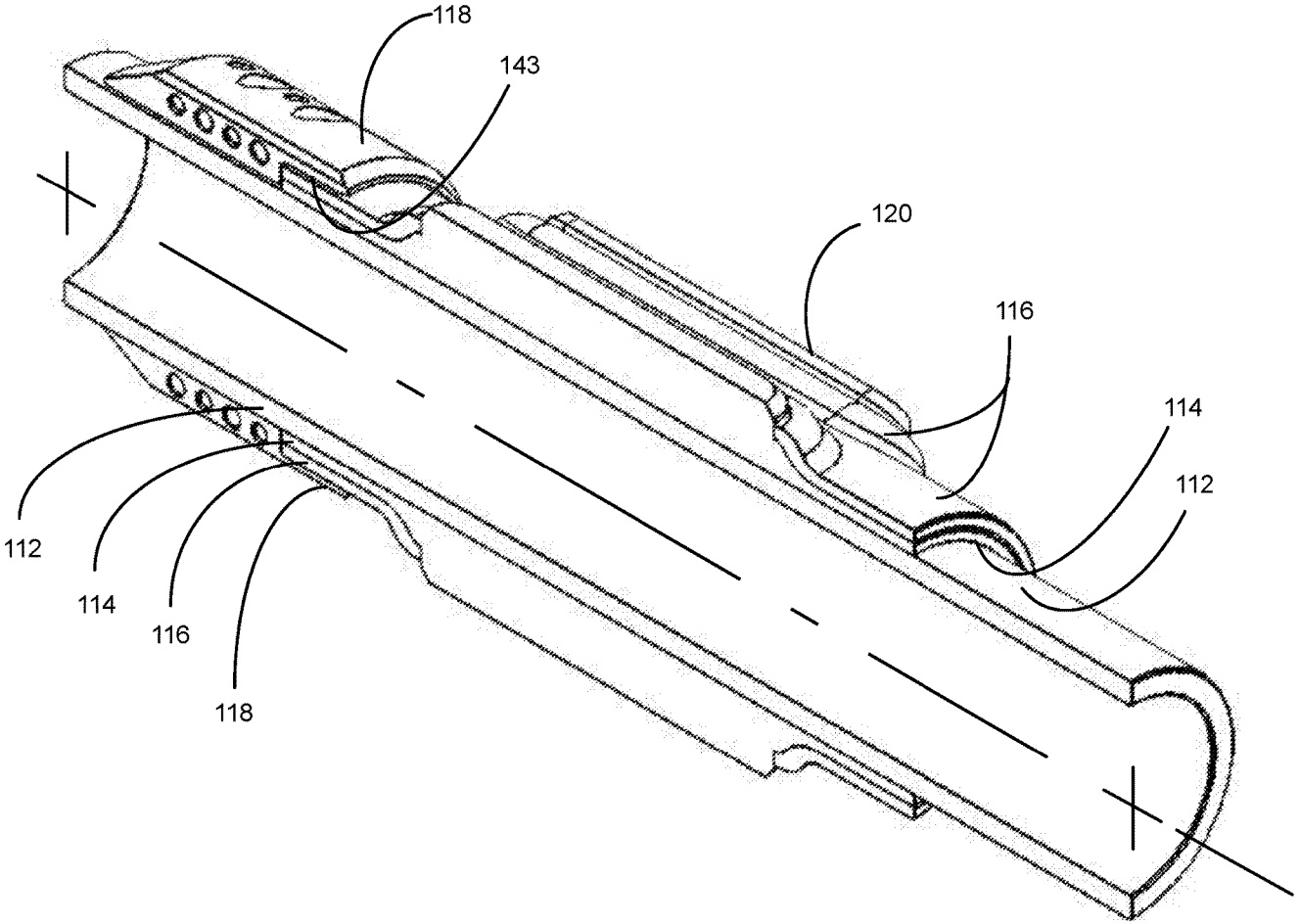
FIG. 6 is a perspective, longitudinal view of the resilient-protrusion centralizer of FIG. 2A, sectioned along the tubular axis, one semi-circular support body and one end collar removed for illustrating the inner sleeve, support body and end collar interfaces.
Figure 7:
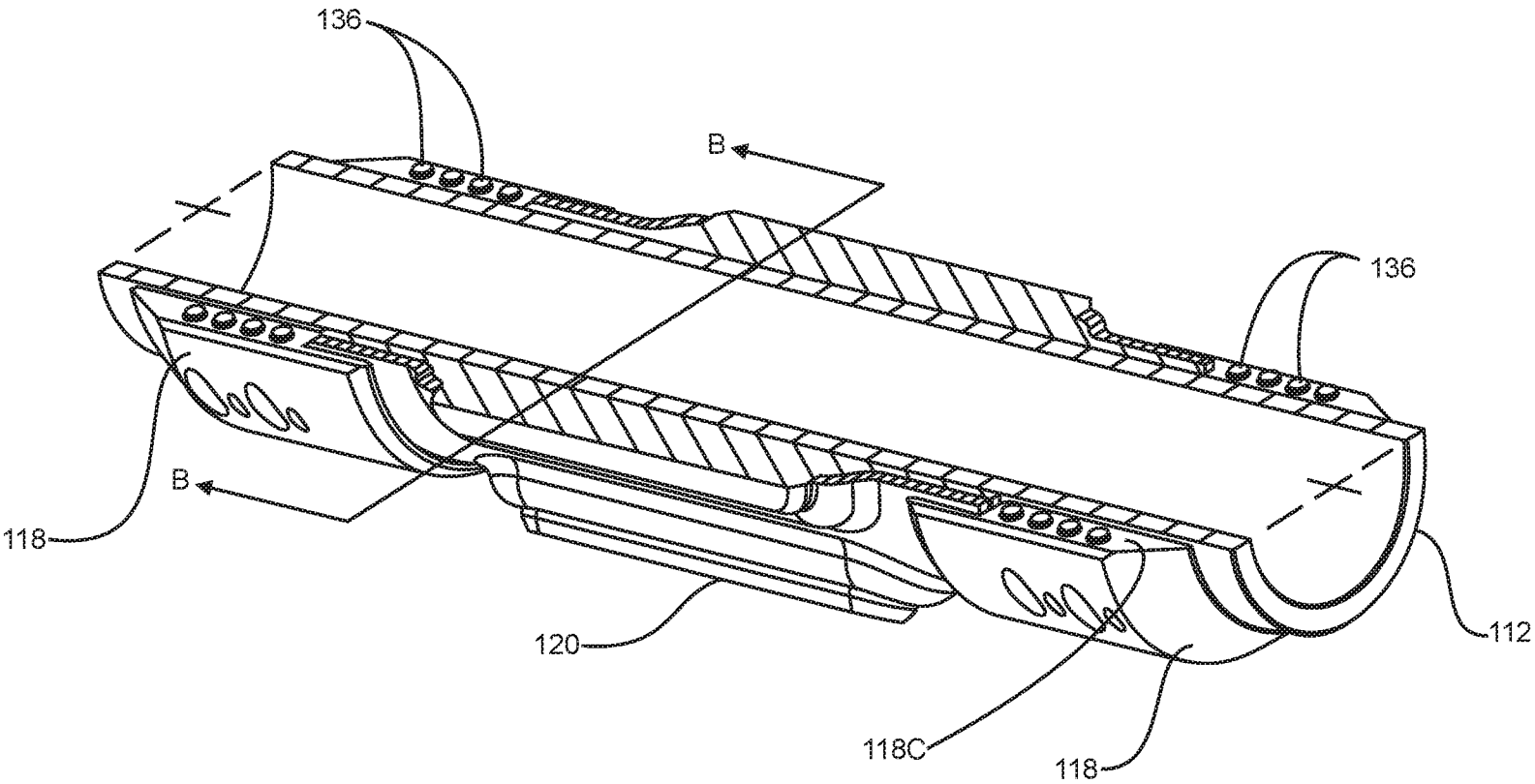
FIG. 7 is a perspective, longitudinal view of the resilient-protrusion centralizer of FIG. 2A, sectioned along the tubular axis.

Turning to FIGS. 6 and 7, the centralizer 110 is assembled around the tubular 112 as follows: the inner sleeve 114 is arranged circumferentially around the tubular 112 and the support body segments 116A are circumferentially arranged around the inner sleeve 114, the protruding members 120 being aligned and fit to the corresponding windows. The protruding members 120 are received within the windows 128 and project radially outwardly therethrough. The various components are held in place by the bookend end collars 118, 118. As also shown in isolation in FIG. 8, the annular overlapping portions 143, 143 of the end collars 118, 118 are axially located about the respective downhole and uphole ends 130, 130 of the support body 116. As shown in this embodiment, and illustrated where the opposing end collar 118 has been omitted in FIG. 6 for viewing the ends 122, 130, the inner sleeve's ends 122, 122 happen to be coincident with the ends 130, 130 of the support body 116.

Figure 8:
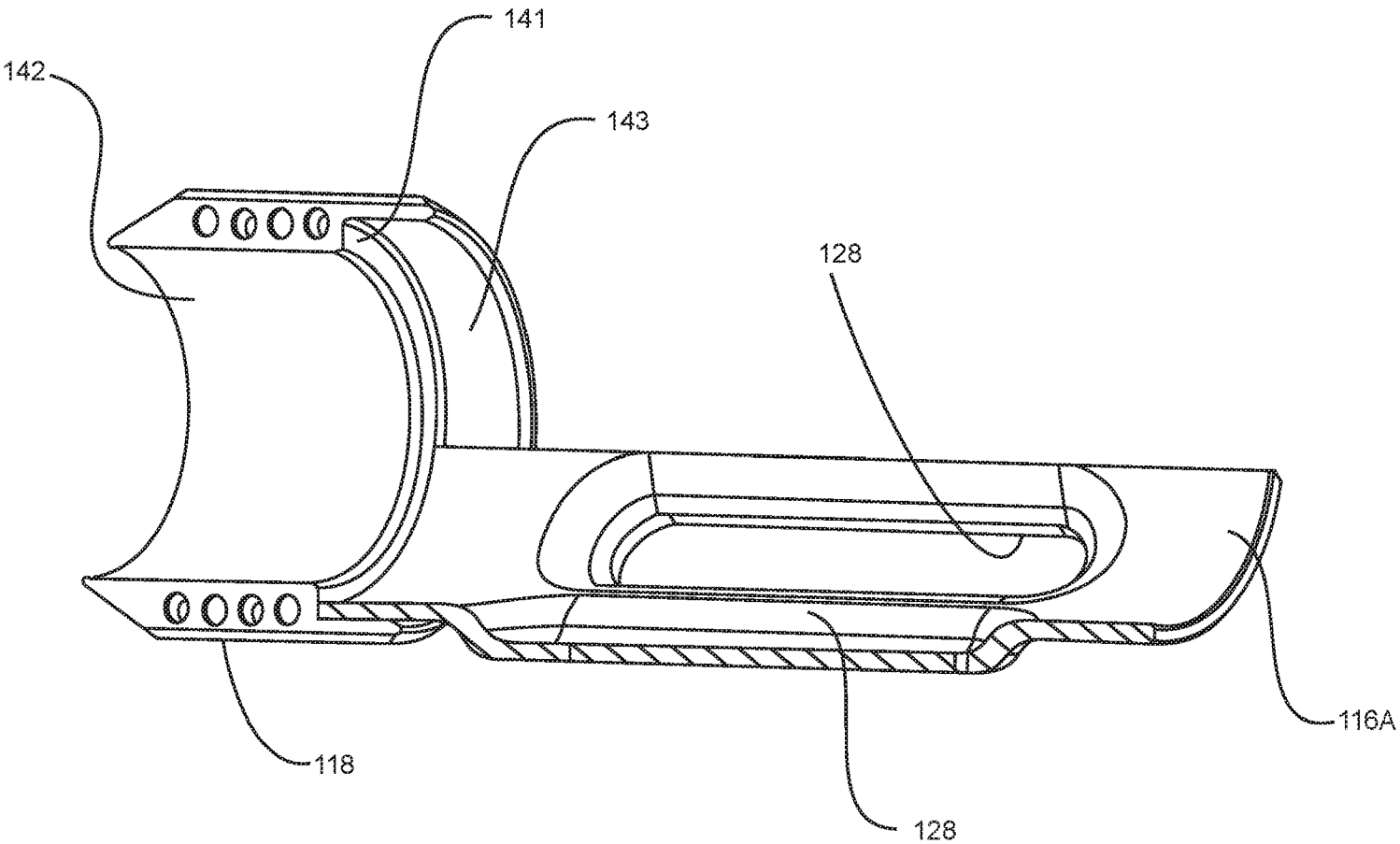
FIG. 8 is a perspective side cross-sectional view of one half of the end collar of FIG. 5 with one support body segment supported therein.
Figure 9A:
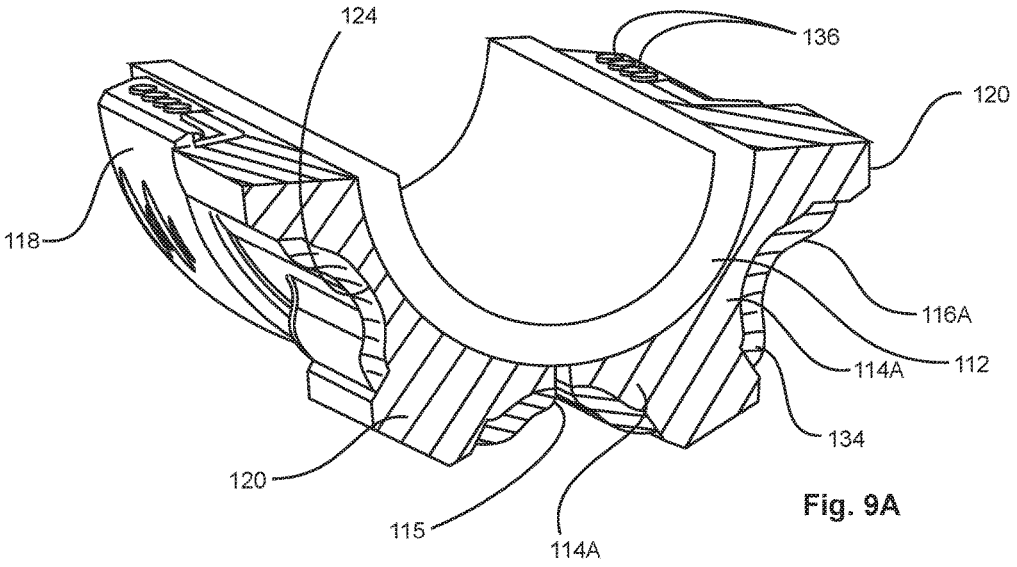
FIGS. 9A and 9B are cross-sectional views along line B-B of FIG. 7, more particularly.
Figure 9B:
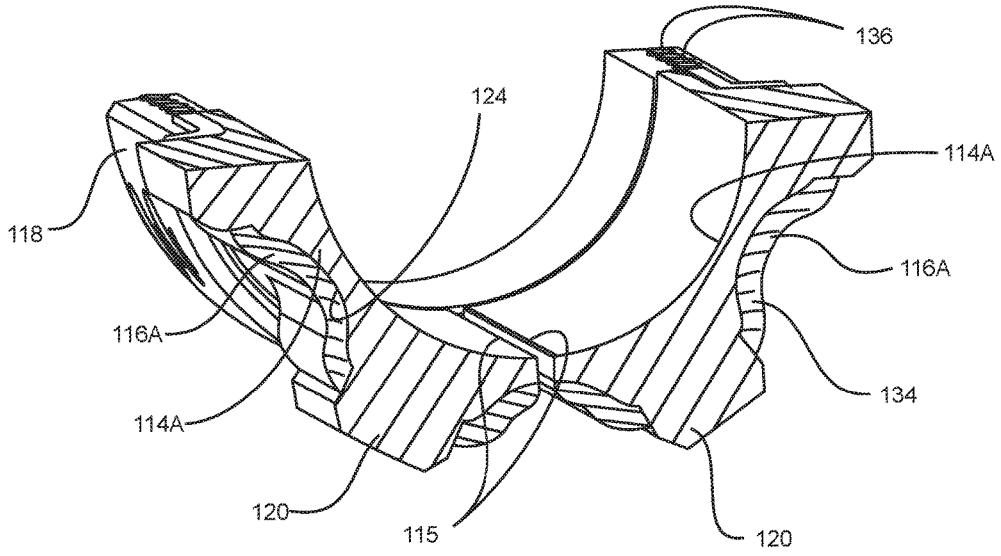

Also shown in FIGS. 8 to 9B, when the second diameter portion or clamping bore 142 of the end collars 118 are secured to the tubular 112, the end collars 118, 118 retain the support body 116 and the inner sleeve 114 about the tubular 112. The opposing ends 122, 122 and end portions 130, 130 of the inner sleeve 114 and the support body 116, respectively are received within the first diameter section 140 of the end collar 118, the annular overlapping portion 143 radially retaining the support body 116 against the inner sleeve 114 which is retained against the tubular 112. The ends 130, 130 of the support body 116 abut the respective shoulders 141, 141 for fixing the axial position of the inner sleeve 114 and support body 116. This enables the inner sleeve 114 and the support body 116 to be circumferentially supported around the tubular 112. The stop shoulders 141, 141 also axially delimit the support body 116 against movement along the tubular 112. Depending on the clearances between the support body 116 and the end collar 116 and between the inner sleeve and tubular 112, the inner sleeve 114 and support body 116 could rotate about the tubular 112. The second diameter section 142 of the end collar 118 grips the tubular 112 for positioning and fixing the support body 116 and the inner sleeve 114 on the tubular 112.

In order to minimize interference or catching with casing collars and other discontinuities during installation and use, the leading and trailing longitudinal edges of all components can be chamfered including the end collars 118, the support body buttresses 134, and the protruding member 120.

Once assembled, the protruding members 120 on the inner sleeve extend beyond the support body 116 to a radial extent greater than that of the end collars 118, 118 for spacing the tubular 112, the support body 116 and the end collars 118, 118 from the walls of the casing or wellbore. This also minimizes contact between the support body 116 and the wellbore or casing sidewalls. Due to the unique construction of the inner sleeve 114 and the support body 116, no connectors are required to retain the inner sleeve 114 and the support body 116 together. Engagement of the protruding members 120 with the windows 128 retains the inner sleeve 114 within the support body 116. The only connectors required are associated with the end collars 118, 118 for retaining and positioning the inner sleeve 114 and the outer body 116 about the tubular 112. The unique construction of the annular end collars 118, 118 enables the end collars 118 to be secured about the support body 116 using minimal connectors. The configuration of the centralizer 110 is therefore less complicated, having minimized the number of connectors, therefore minimizing the risk of failure and reducing the cost and assembly time.

As the only contact between the centralizer 110 and casing or wellbore walls is the protruding members 120, the inner sleeve 114 is prone to wear and tear and is sacrificial. Multi-segment construction of the inner sleeve 114 enables replacement of only the inner sleeve segment 114A with worn protruding members. Only those individual inner sleeve segments 114A whose one or more protruding members 120 are worn sufficiently to warrant replacement are need be replaced at any one time however conservative practices may dictate replacing all at once. The method for replacement of inner sleeve segments 114A with worn protruding members 120 typically comprises disengaging at least one of the annular end collars 118 and removing one or more of the support body segments 116A for accessing the inner sleeve segments 114A. The inner sleeve segments with worn protruding members 120 are then removed and replaced with replacement inner sleeve segments. The replacement inner sleeve segments and the support body segments are then re-installed about the tubular and the disengaged annular end collar is secured to the tubular and about the opposing end portion of the support body.

Figure 10:
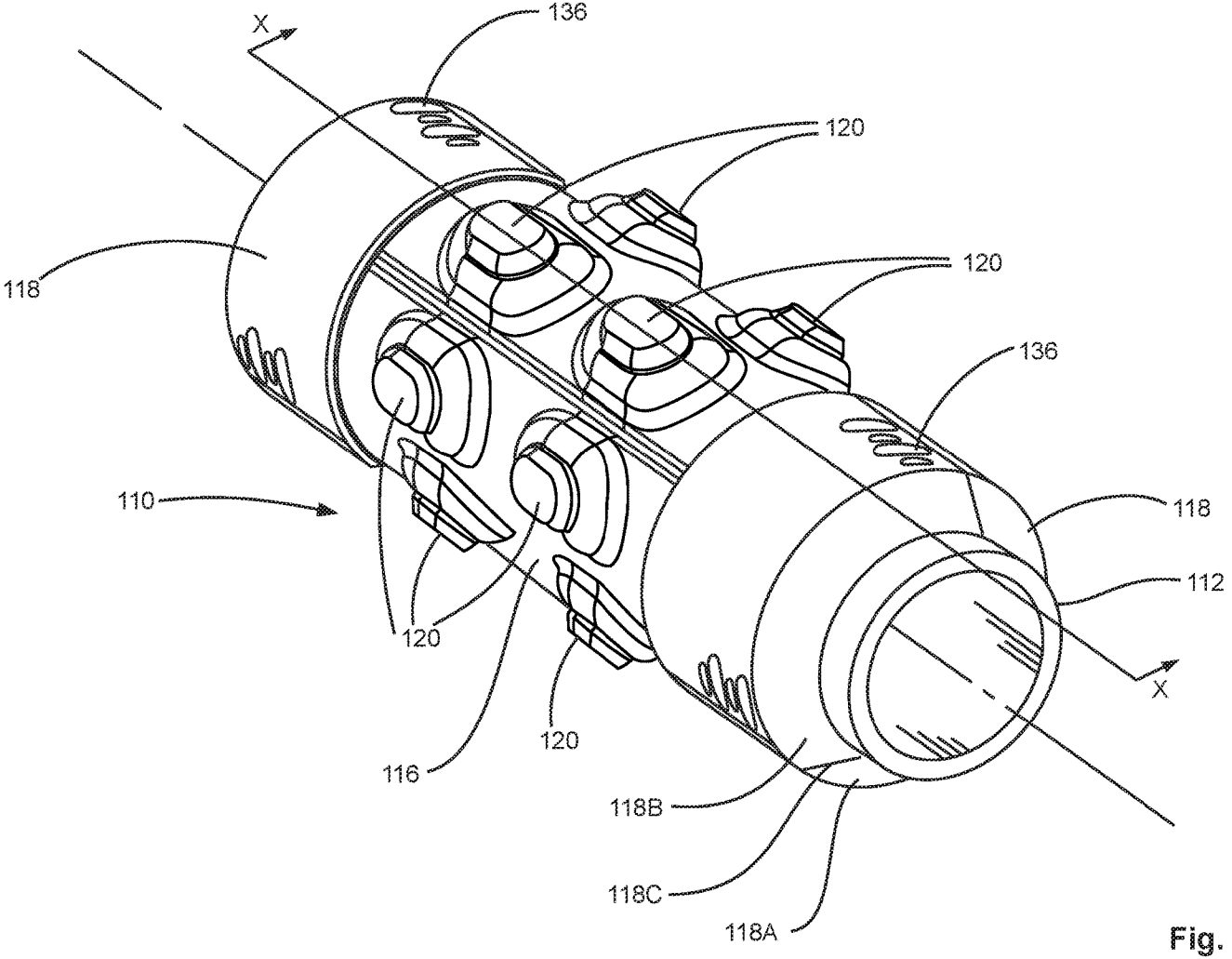
FIG. 10 is a perspective view of another embodiment of a resilient-protrusion centralizer and having one or more tubular resilient inner sleeve sections arranged between the support body and the tubular, each resilient inner sleeve section having resilient protrusions extending from the inner sleeve and through ports or windows formed in the outer support body.
Figure 11:
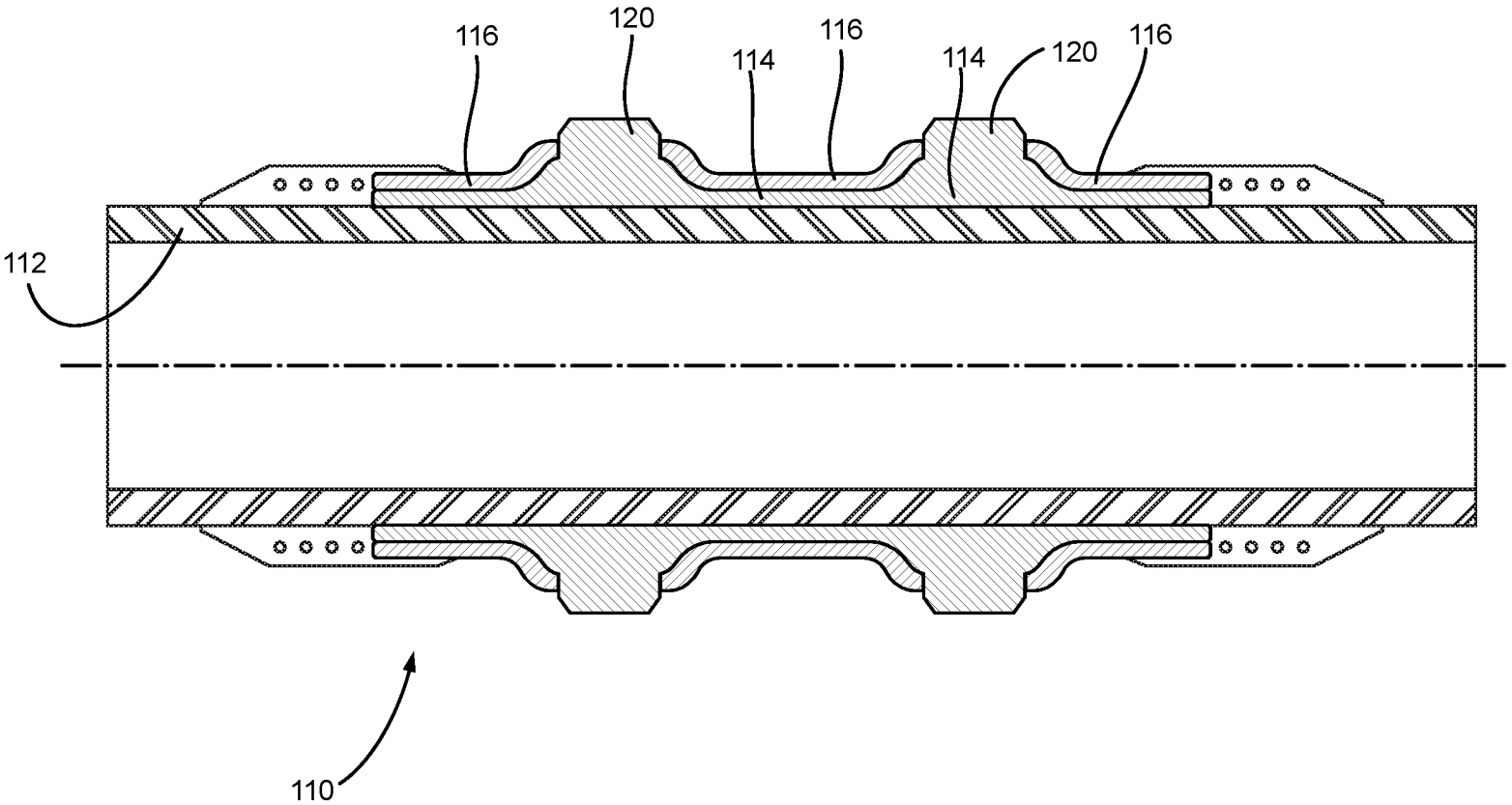
FIG. 11 is a side cross-sectional view of the centralizer of FIG. 10 along line X-X.

FIGS. 10 and 11 show a resilient-protrusion centralizer according to another alternative embodiment. As shown, the outer support body 116 comprises a plurality of windows or ports distributed circumferentially and axially thereon. Correspondingly, a plurality of resilient protrusions 120 extends from the inner sleeve 114 through the circumferentially and axially distributed windows or ports of the outer support body 116.

Hard-Protrusion Centralizers

Figure 12:
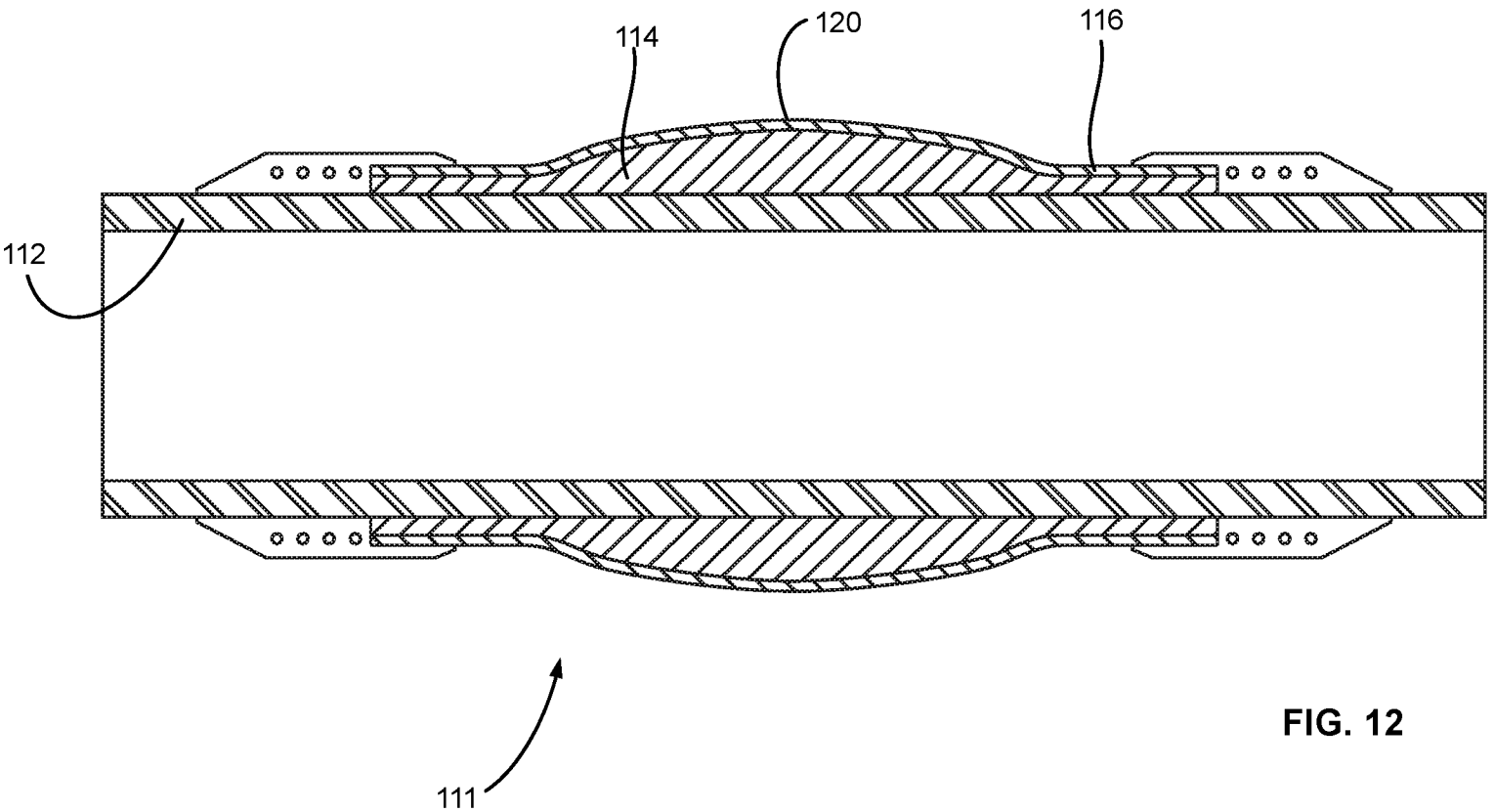
FIG. 12 is a cross-sectional view of one embodiment of a hard-protrusion centralizer, shown installed on a section of tubular, and having a resilient inner sleeve extending beneath the outer support body and contour-fitting thereto.

FIG. 12 shows a hard-protrusion centralizer 111 according to one embodiment. Similar to the above-described resilient-protrusion centralizer 110, the hard-protrusion centralizer 111 is installed on a section or joint of a tubular 112 such as a drill pipe, and comprises a resilient inner sleeve 114 sandwiched between an outer supporting body 116 and the tubular 112. The outer support body 116 is generally manufactured of metal such as steel. A portion of the supporting body 116 extends radially outwardly, forming a circumferentially continuous, hard protrusion 120, having a radial tip for engaging the wellbore. Other parts and components of the hard-protrusion centralizer 111 are generally the same as those of the above-described, resilient-protrusion centralizer 110, and are therefore omitted.

In this embodiment, the inner sleeve 114 also extends beneath the outer support body 116, and is contour-fitting to the outer support body 116 for support of the protrusion 120.

In another embodiment, the hard protrusion 120 is not circumferentially continuous. Rather, the hard-protrusion centralizer 111 may comprise a plurality of circumferentially spaced hard protrusions.

In another embodiment, the hard-protrusion centralizer 111 may comprise a plurality of axially spaced hard protrusions.

In another embodiment, the hard-protrusion centralizer 111 may comprise a plurality of circumferentially and axially spaced hard protrusions.

Figure 13:
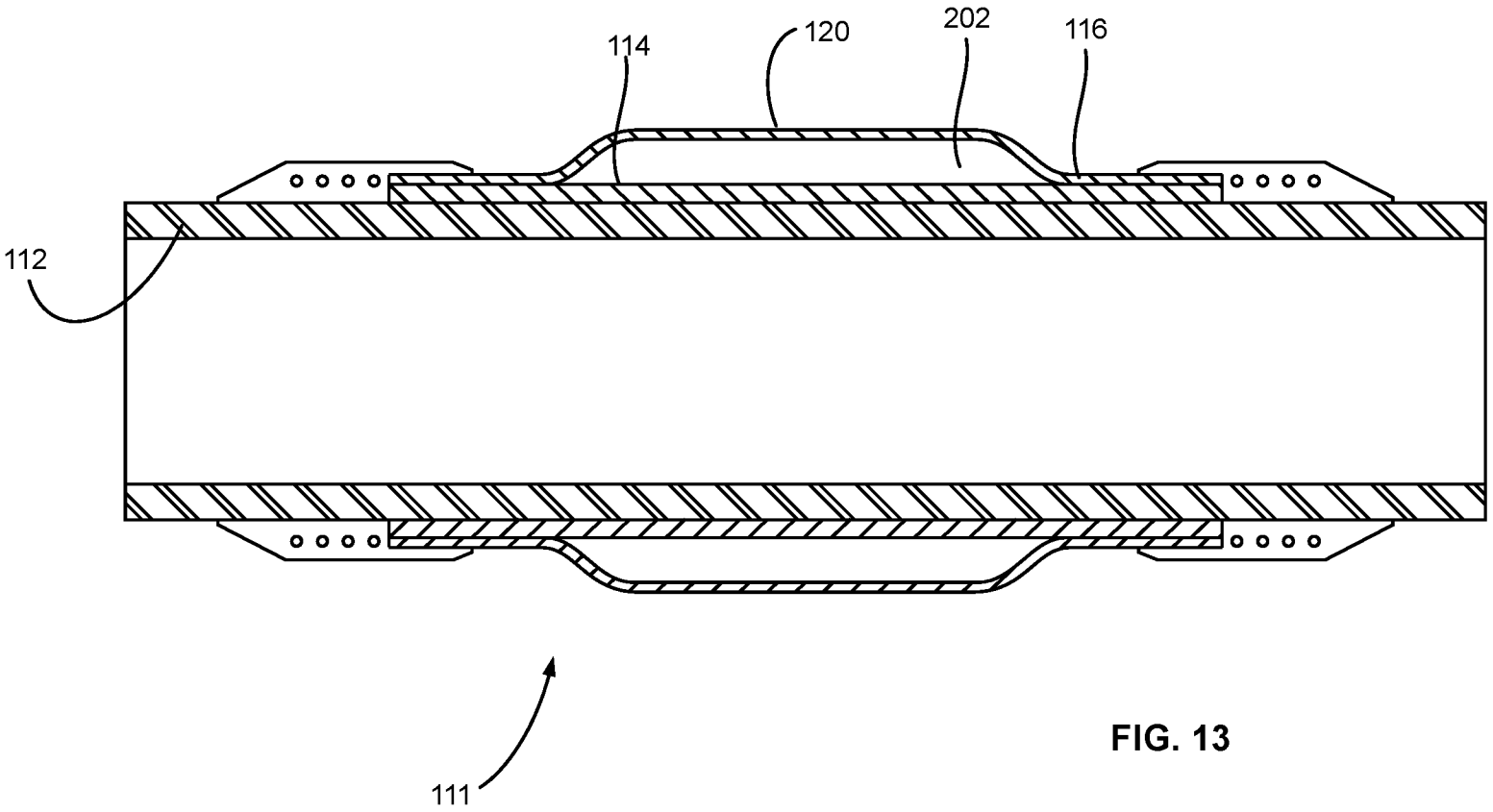
FIG. 13 is a cross-sectional view of another embodiment of a hard-protrusion centralizer having a resilient inner sleeve extending beneath the outer support body, an annular gap formed between the sleeve and support body.

FIG. 13 shows a hard-protrusion centralizer 111 according to another embodiment. The hard-protrusion centralizer 111 of FIG. 13 is similar to that of FIG. 12, except that, in this embodiment, the resilient inner sleeve 114 is a cylindrical tubular extending axially beneath the outer support body 116. An annular gap 202 is thus formed between the sleeve 114 and support body 116, the support body 116 having sufficient structure to be self-supporting under load.

Figure 14:
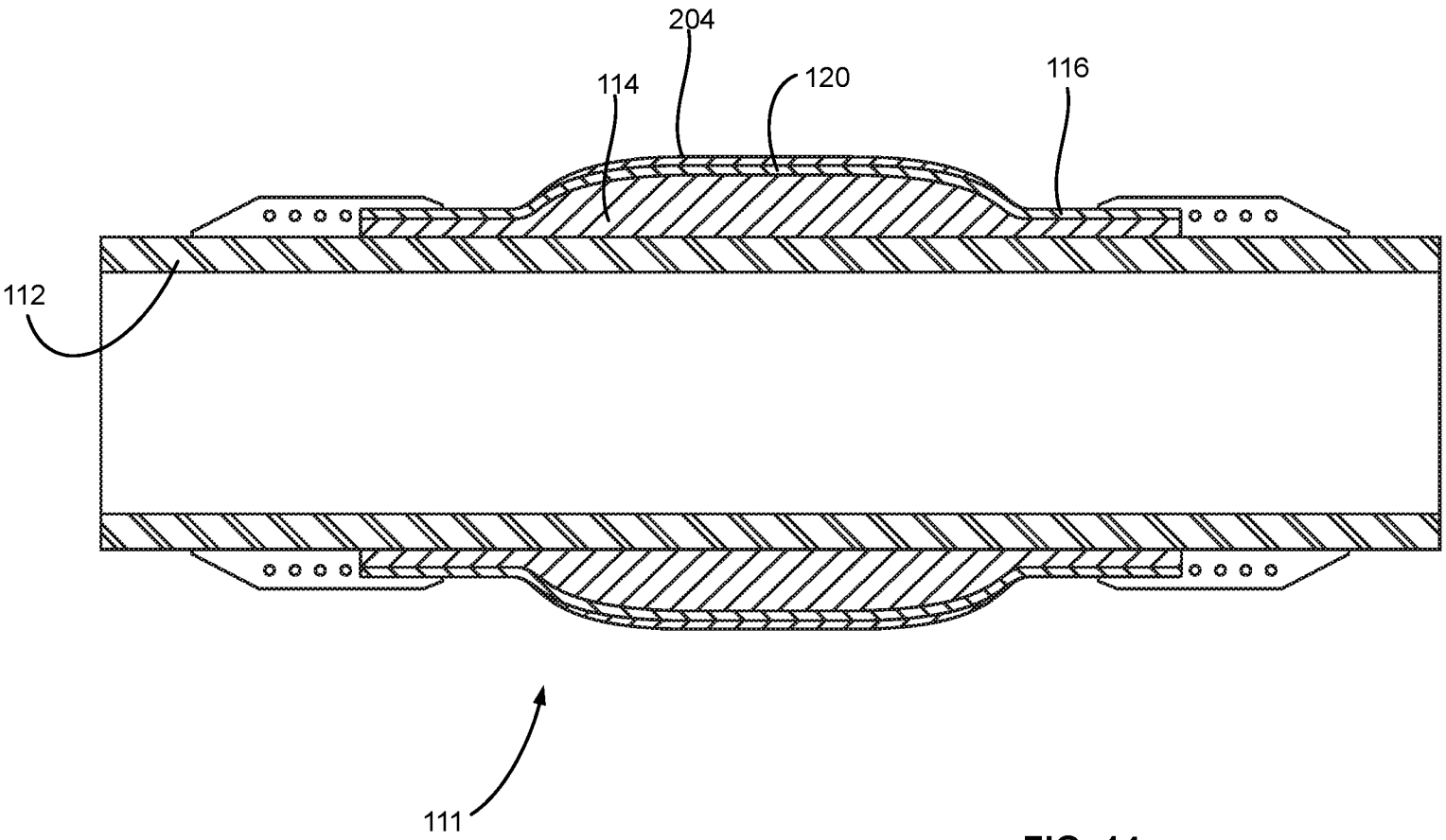
FIG. 14 is a cross-sectional view of another embodiment of a hard-protrusion centralizer having a resilient inner sleeve extending beneath the outer support body and contour-fitting thereto, the hard protrusion portion of the support body also being hard-faced.

FIG. 14 shows a hard-protrusion centralizer 111 according to another embodiment. The hard-protrusion centralizer 111 of FIG. 14 is similar to that of FIG. 13. However, in this embodiment, at least one of the hard protrusion portions 120 is further hard-faced with stiff or wear-resistant material 204 such as tungsten carbide. The advantage of this embodiment is that the hard protrusion will last much longer before the protrusion wears down.

Figure 15:
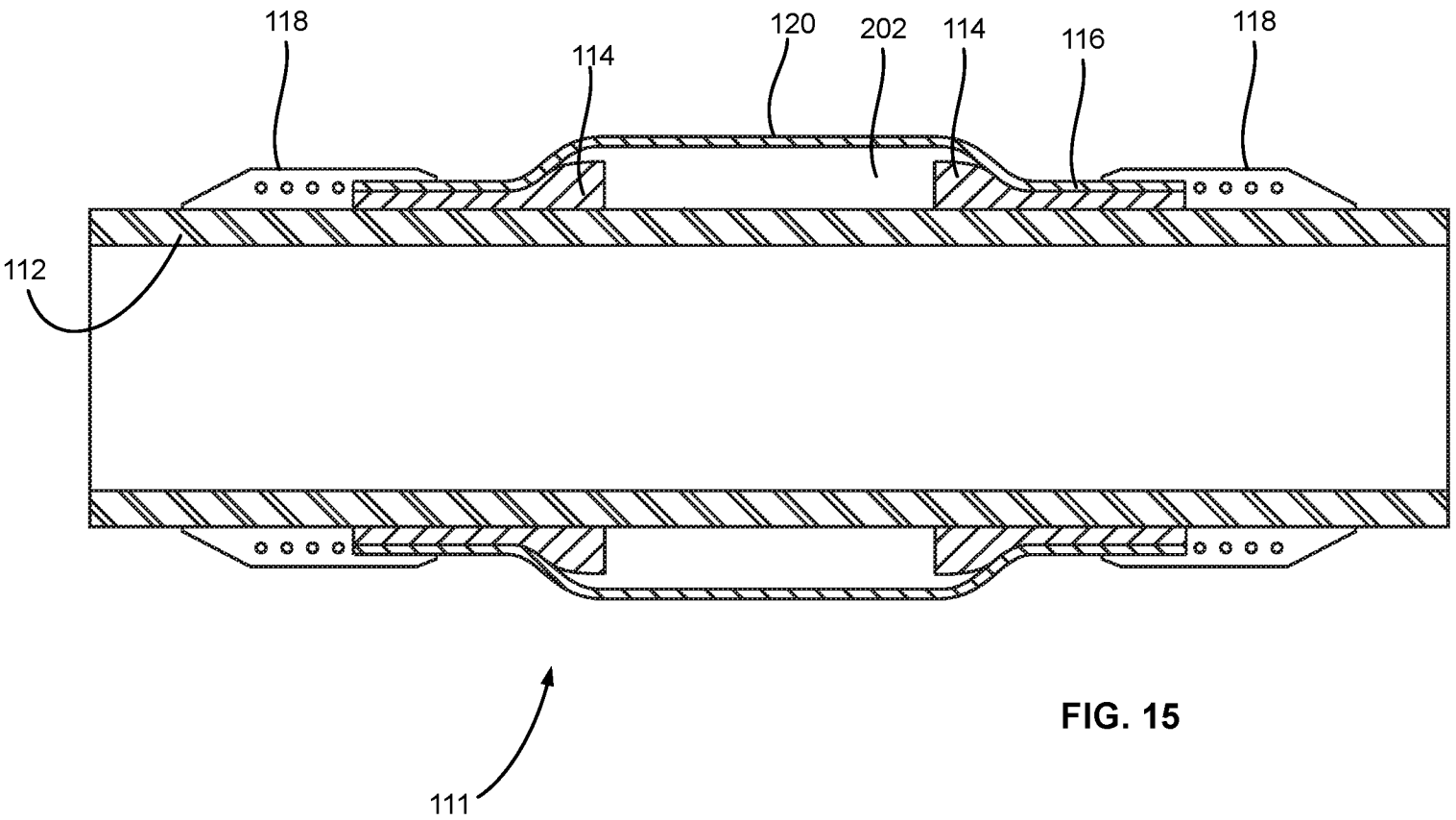
FIG. 15 is a cross-sectional view of another embodiment of a hard-protrusion centralizer having a two part, resilient inner sleeve extending partially beneath each end of the outer support body, an annular gap formed between the two sleeves and between the tubular and the support body.

FIG. 15 shows a hard-protrusion centralizer 111 according to yet another embodiment. In this embodiment, the hard-protrusion centralizer 111 comprises a two part, resilient inner sleeve 114 extending partially beneath each end of the outer support body 116. The inner sleeve 114 is retained axially by suitable means, such as by the bookend end collars 118, 118. An annular gap 202 is formed between the two sleeves 114, and between the tubular 112 and the support body 116. In this embodiment the inner sleeves might have to be attached to the outer sleeve segments by means of gluing or vulcanizing so that the inner sleeves do not drift away from their intended (as shown) position in the axial direction.

Drilling Method Using Resilient-Protrusion and Hard-Protrusion Centralizers

Figure 16A:
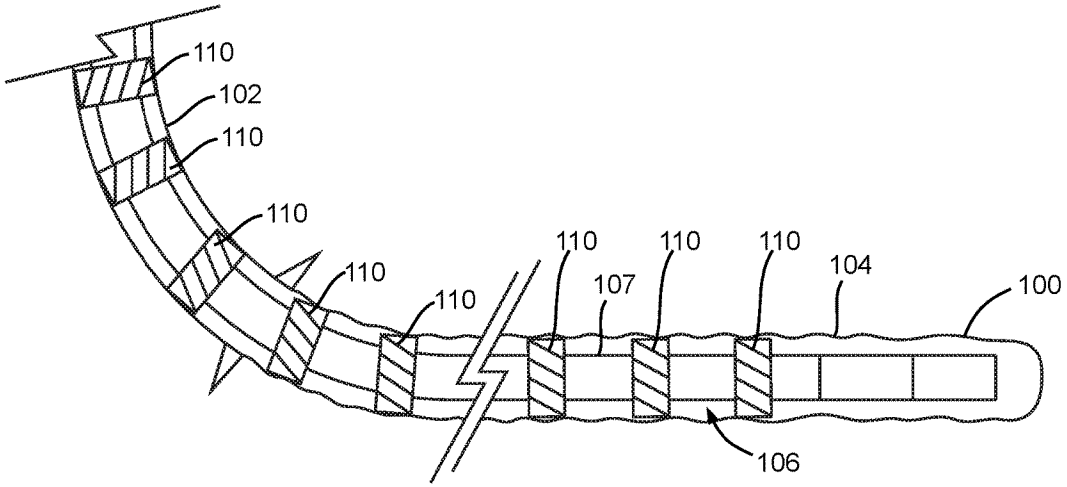
FIGS. 16A to 16C illustrate a drilling operation using centralizers, bent sub, and a drilling bit and a mud motor at a distal end thereof, the drilling operation continuing out of the cased wellbore portion and into an openhole horizontal section; in particular.
Figure 16B:
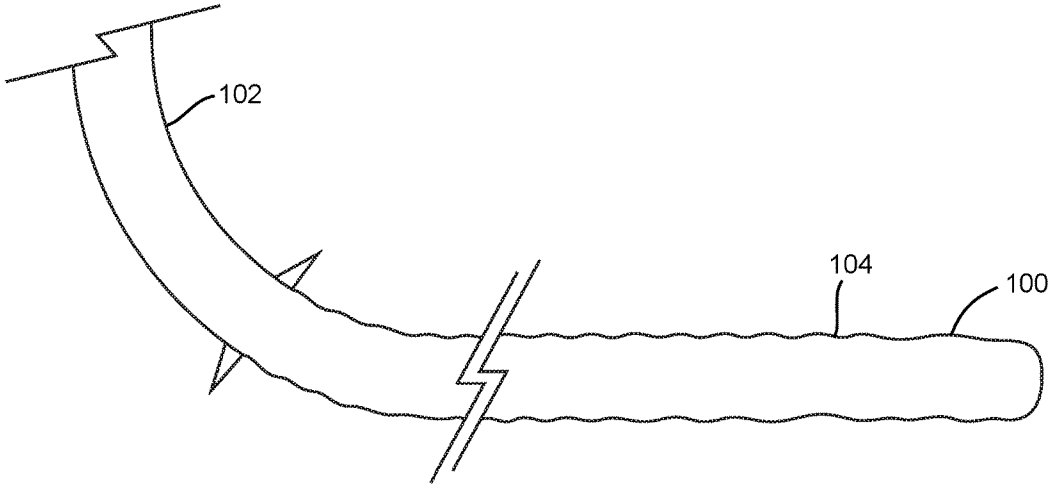
Figure 16C:
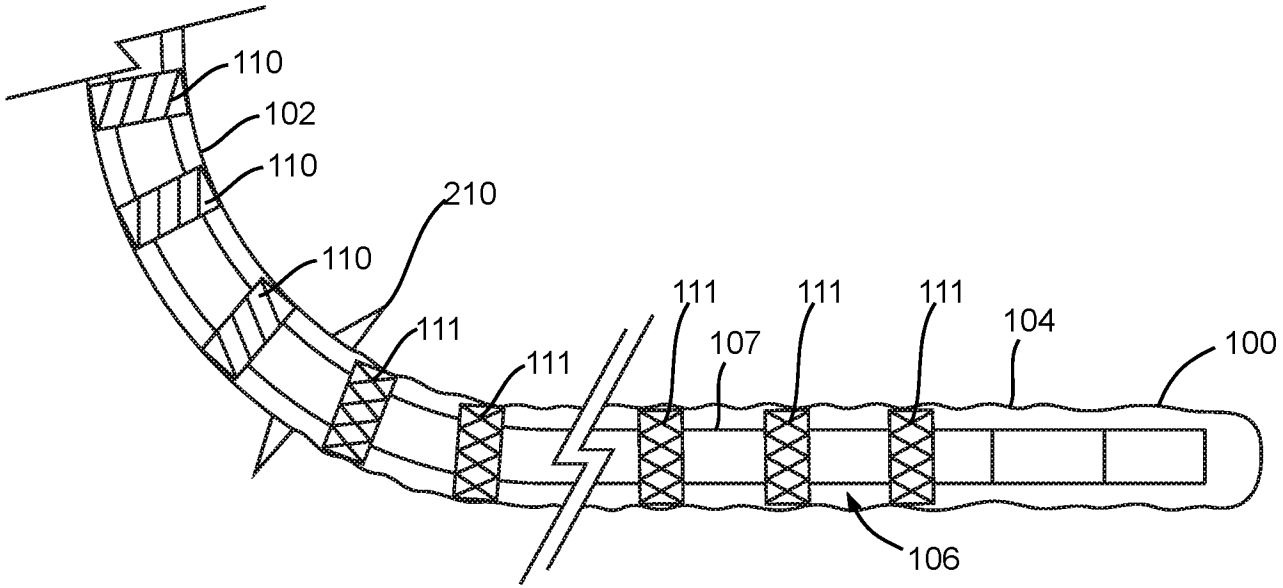

FIGS. 16A to 16C illustrate a drilling method using resilient-protrusion and hard-protrusion centralizers. As shown in FIG. 16A, one can drill with resilient centralizers 110 spaced along the drill string 106, to protect the cased portion 102 of the wellbore 100 at least until a portion of the horizontal portion is drilled. The resilient centralizers 110 are particularly important to minimize wear to the casing as the drill string 106 advances therethrough. The drilling continues out the end of the casing shoe 210 and into openhole 104, and some resilient-protrusion centralizers 110 move into the openhole portion 104. As the resilient-protrusion centralizers 110 are not optimal for openhole, some resilient-protrusion centralizers 110 exposed to the openhole environment may be worn or damaged.

As shown in FIG. 16B, coincident with a bit change, the drill string 106 is tripped out. The worn or damaged resilient-protrusion centralizers 110 on the downhole distal end of the drill string 106 are removed and replaced with hard-protrusion centralizers 111. In particular, a downhole length of the drill string 106 that will be extended into the openhole 104 is determined and this portion is fit with the hard-protrusion centralizers 111. The balance of the drill string 106 that will, for the most part, remain in the existing casing 102 and is fit with the resilient centralizers 110. As shown in FIG. 16C, the drill string 106 with both resilient-protrusion and hard-protrusion centralizers 110 and 111 is then extended into the wellbore 100 to further drill the wellbore 100.

Of course, as the drill string 106 continues to drill forward, some of the resilient centralizers 110 in the casing 102 move from the casing 102 into the openhole 104, and are then subject to wear and damage. During wellbore drilling, the above described procedure of pulling the drill string 106 out of hole and replacing resilient-protrusion centralizers 110 with hard-protrusion centralizers along a projected openhole portion of the drill string 106 may be repeated a few times as necessary or coordinated with other bottom hole assembly servicing.

With the above described drilling method (FIGS. 16A to 16C), hard-protrusion centralizers 111 are used on the portion of the drill string 106 that spends most of its time in openhole 104, for combating centralizers wearing out or damage, and resilient protrusion centralizers 110 are used in the portion of the drill string 106 that spends most of their time in the casing 102, for protecting the casing 102. Significant operational advantages are realized.

Centralizer with both Resilient and Hard Protrusions

Figure 17A:
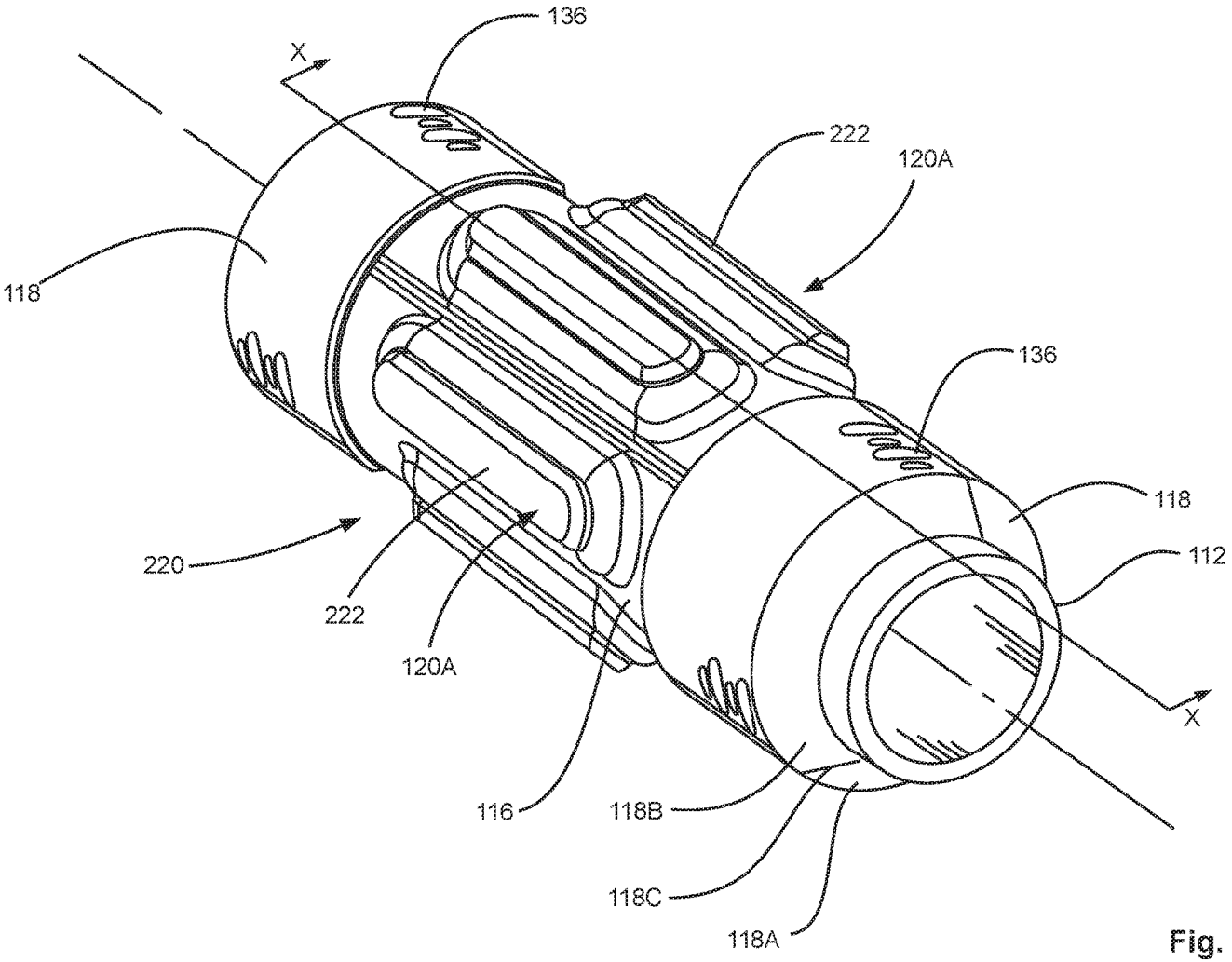
FIG. 17A is a perspective view of a tubular centralizer having both resilient and hard protrusions, and shown installed on a section of tubular, according to an alternative embodiment.
Figure 17B:
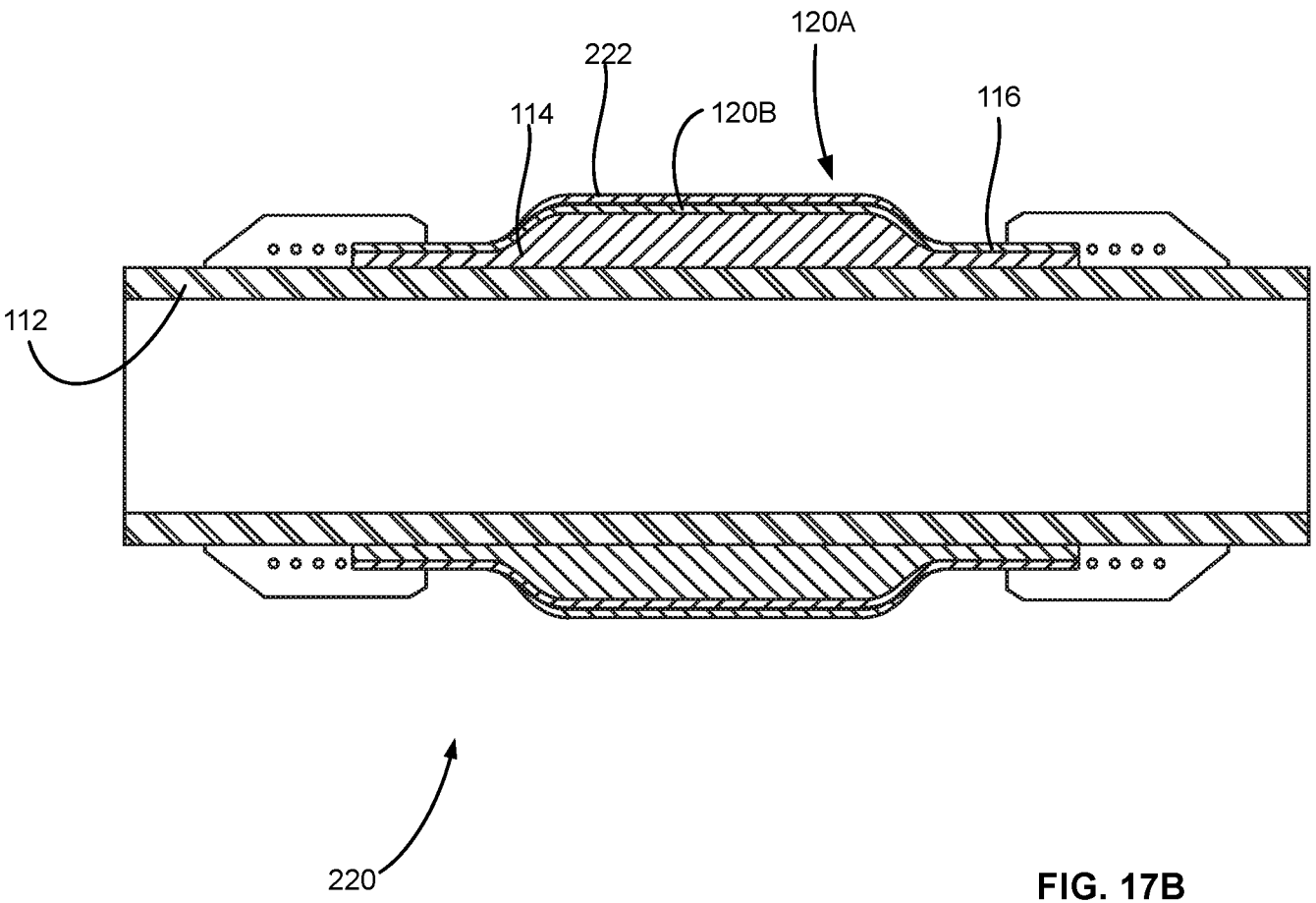
FIG. 17B is a side cross-sectional view of the centralizer of FIG. 17A along line X-X.

FIGS. 17A and 17B show a centralizer 220 having both resilient and hard protrusions (also denoted as resilient/hard protrusion centralizer or transition centralizer hereinafter), according to an alternative embodiment. The resilient/hard protrusion centralizer 220 of FIGS. 17A and 17B is similar to that of FIG. 14. However, in this embodiment, the hard protrusion(s) 120B is covered with an outermost resilient layer 222 to form resilient protrusion(s) 120A. Any suitable means, such as screwing, coating, gluing, vulcanizing and the like, may be used to cover the outermost resilient layer 222 to the hard protrusion(s) 120B. For example, the outermost resilient layer 222 may be a resilient polyurethane coating that is bonded to the support body 116.

Figure 18A:
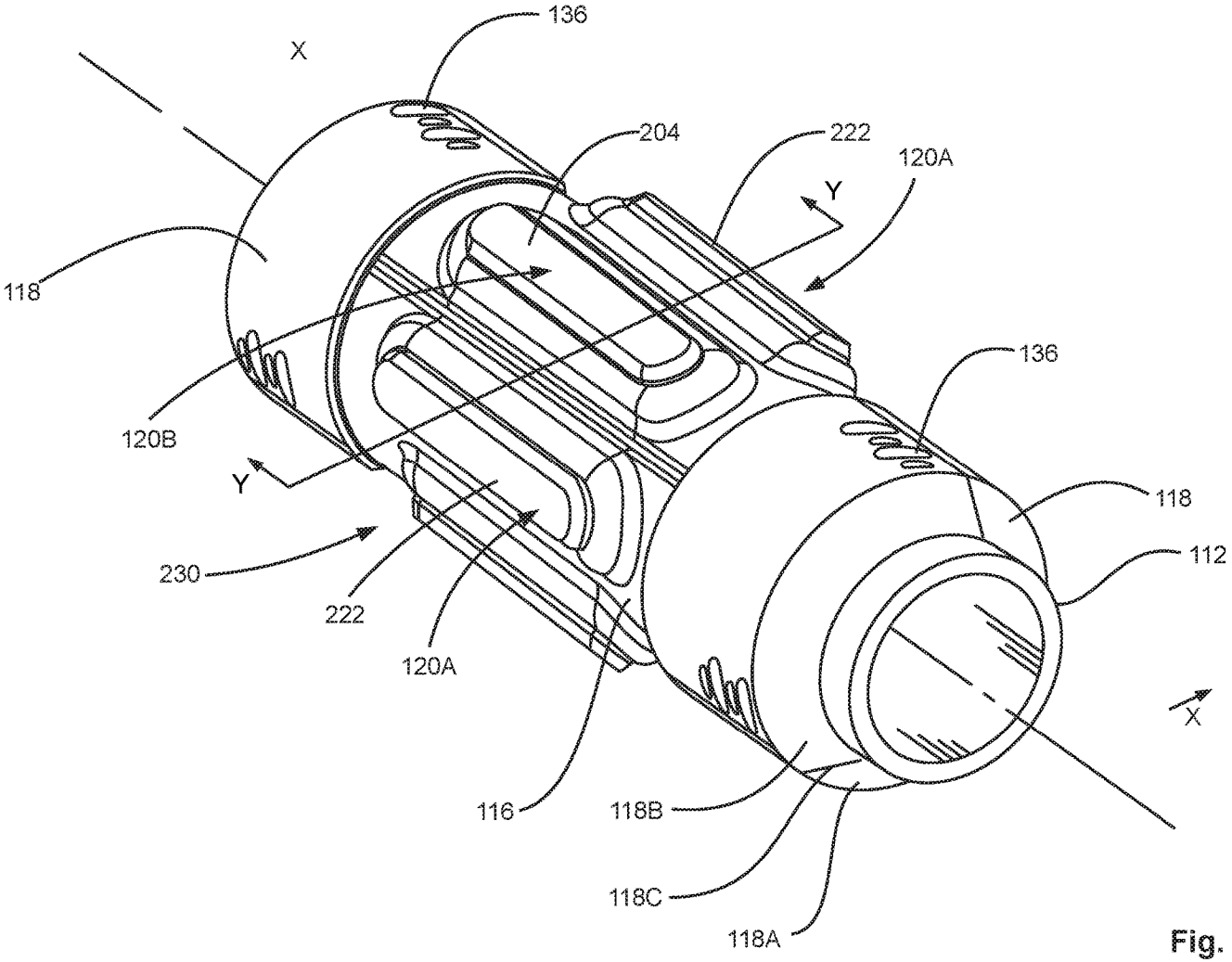
FIG. 18A is a perspective view of a tubular centralizer having both resilient and hard protrusions, and shown installed on a section of tubular, according to an alternative embodiment.
Figure 18B:
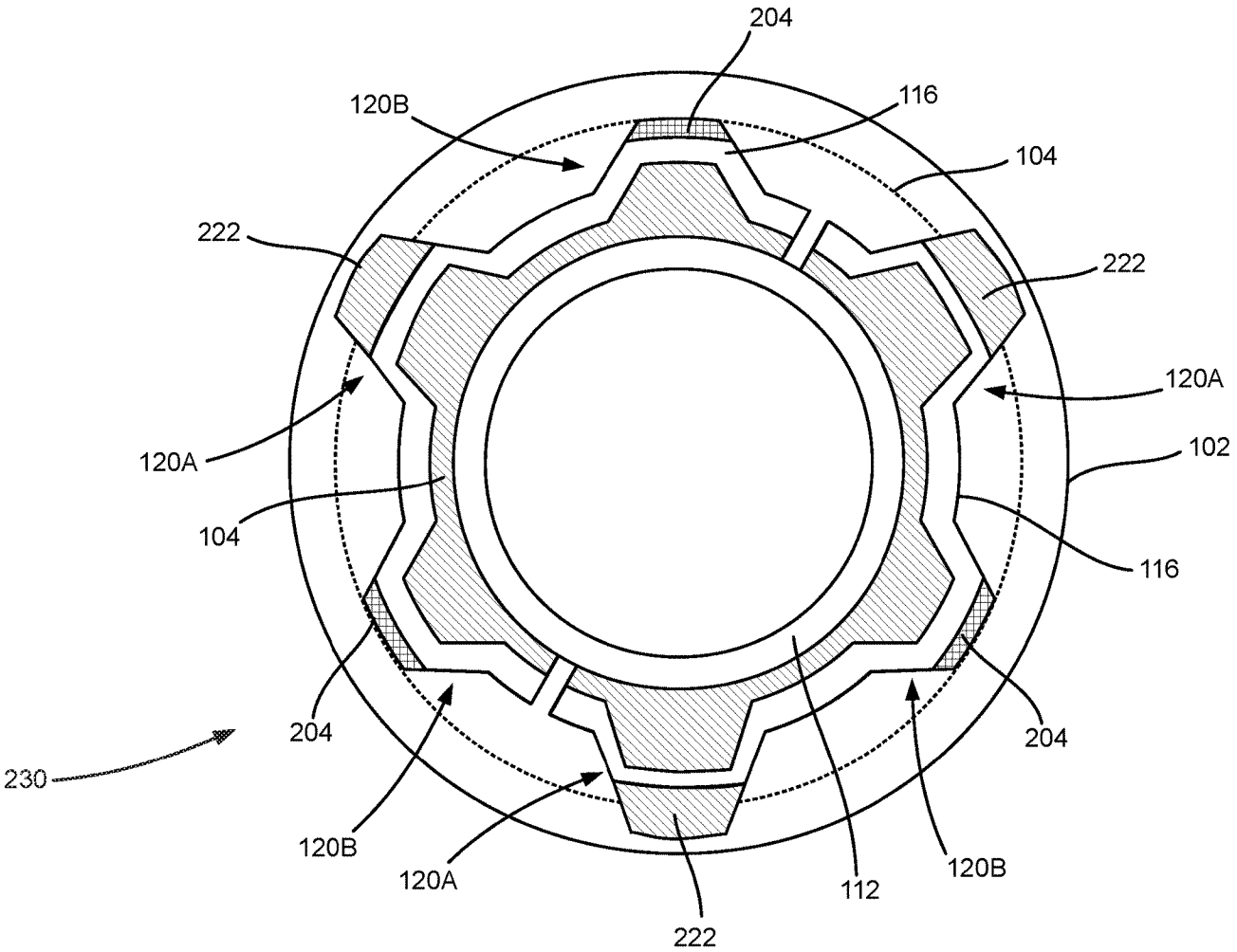
FIG. 18B is a cross-sectional view of the centralizer of FIG. 18A along line Y-Y.

In above embodiment, all hard protrusions 120B are covered with an outermost resilient layer 222. In an alternative embodiment, only some of the hard protrusions 120B are covered with an outermost resilient layer 222. For example, as shown in FIGS. 18A and 18B, the resilient/hard protrusion centralizer 230 comprises three resilient protrusions 120A and three hard protrusions 120B, preferably circumferentially alternately distributed. Protrusions 120A and 120B in this example are formed by the radially outwardly extended portions of the support body 116. However, the resilient protrusions 102A are covered by outermost resilient layer 222, and the hard protrusions 120B are hard-faced with stiff material 204.

In this example, the cased portion 102 has a slightly larger diameter than that of the openhole portion 104. Correspondingly, the resilient protrusions 120A have a first radial extent slightly smaller than that of the cased portion 102, i.e., the resilient protrusions 120A radially outwardly extending to about, but slightly smaller than, the inner surface of the casing 102. The hard protrusions 1206 have a second radial extent slightly smaller than that of the openhole portion 104, i.e., the hard protrusions 120B radially outwardly extending to about, but slightly smaller than, the wall of the uncased wellbore 104. The first radial extent of the resilient protrusions 120A is greater than the second radial extent of the hard protrusions 120B. The so formed centralizer is then a dual-gauge centralizer having two centralizer diameters corresponding to the above-described first and second diameters.

For example, wellbore drilling in Canada commonly uses 7" Outer Diameter (OD) casing to the 90-degree location (the "heel" of a horizontal well, where the wellbore is transiting from vertical to horizontal). A 7" casing under a typical 17 pounds per foot (ppf) pressure gives rise to a 6.538" casing Inner Diameter (ID).

Downhole to the 7" casing, a horizontal bore is then drilled with a 6.25" drill bit, typically giving rise to an ID smaller than that of the 7" casing. Generally, the ID of the openhole portion is slightly larger than the diameter of the drill bit due to bit wobble and vibration, and is slightly smaller than the diameter of the drill bit due to bit wearing. Often, a thick "filter cake" may develop on the borehole wall of the openhole portion, which effectively makes the hole size smaller.

Therefore, generally, the centralizers are designed to have ODs smaller than the ID of the casing or openhole. In particular, centralizer protrusions having resilient surfaces are designed to have an OD smaller than the ID of the casing, and centralizer protrusions having hard surfaces are designed to have an OD smaller than the ID of the openhole.

For example, in one embodiment, resilient protrusions 120A are designed to have an OD of about 6.25", and hard protrusions 120B are designed to have an OD of about 6.0" or about 6.1". In this embodiment, the resilient protrusions 120A can fit in the uncased portion without being too tight, slowing wearing thereto, compared to the design of resilient protrusions having larger OD.

Figure 19A:
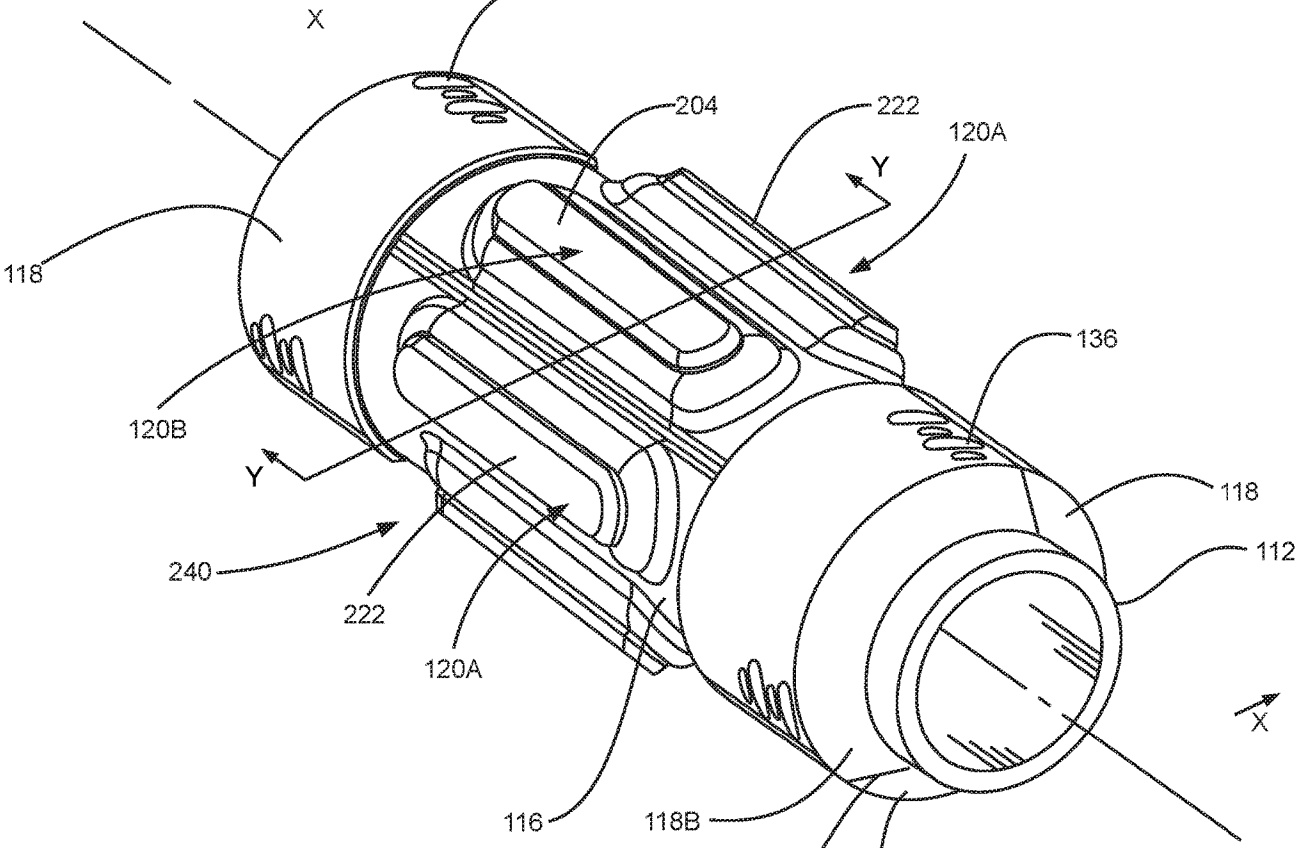
FIG. 19A is a perspective view of a tubular centralizer having both resilient and hard protrusions, and shown installed on a section of tubular, according to an alternative embodiment.
Figure 19B:
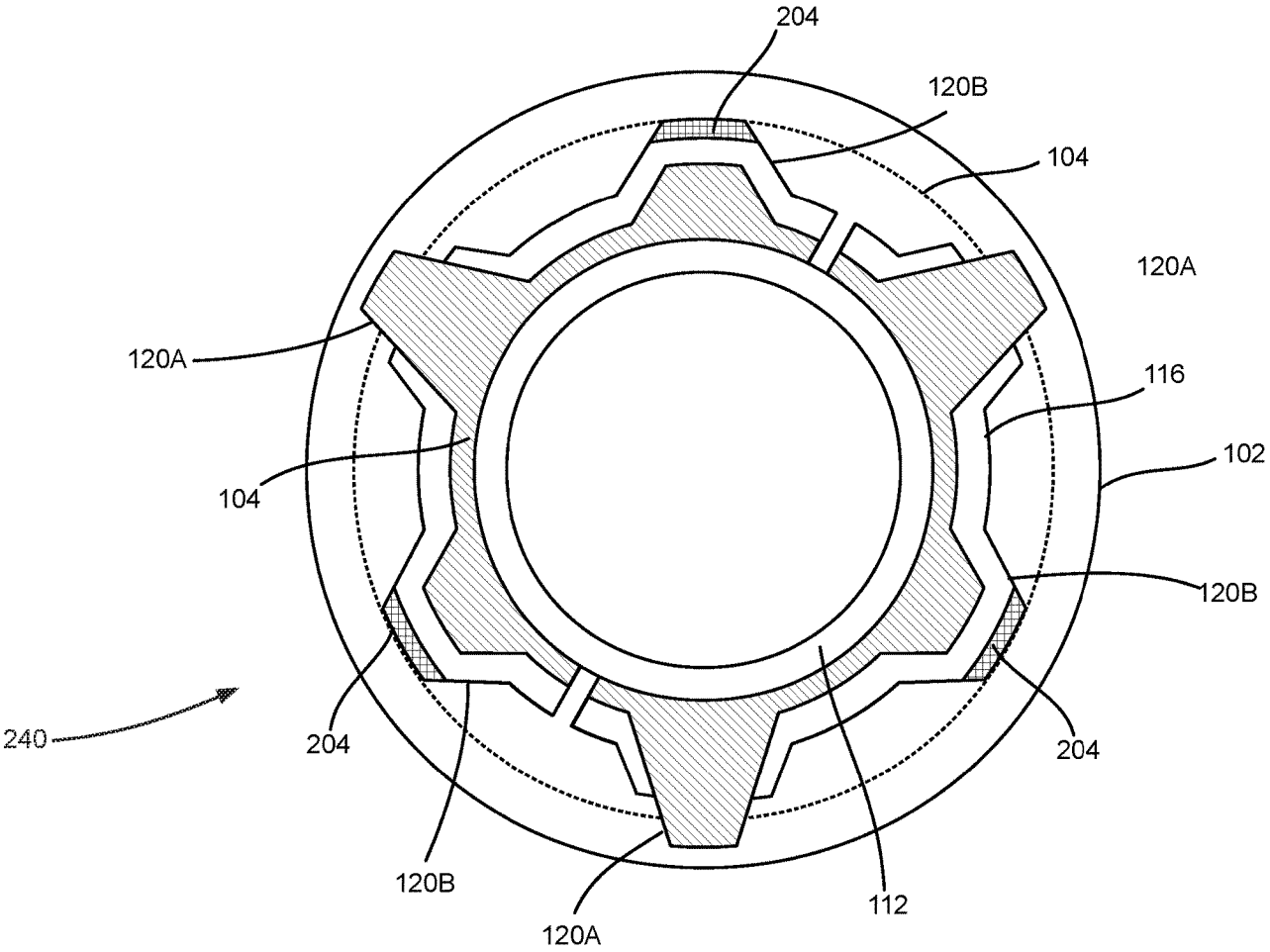
FIG. 19B is a cross-sectional view of the centralizer of FIG. 18A along line Y-Y.

In another embodiment as shown in FIGS. 19A and 19B, the dual-gauge, resilient/hard protrusion centralizer 240 is the same as the dual-gauge, resilient/hard protrusion centralizer 230 of FIGS. 18A and 18B, except that, in this embodiment, the resilient protrusions 120A are formed by extending the resilient inner sleeve 114 out of respective windows of the support body 116. The hard protrusions 120B are formed in a same manner as those of FIGS. 18A and 18B.

Although now shown in the drawings, in one alternative embodiment, a dual-gauge, resilient/hard protrusion centralizer is similar to the centralizer 110 of FIGS. 10 and 11, except that some of the protrusions 120 are hard protrusions and some others thereof are resilient protrusions (formed by the resilient sleeve 114, or by covering hard protrusions with a resilient layer).

Figure 20:
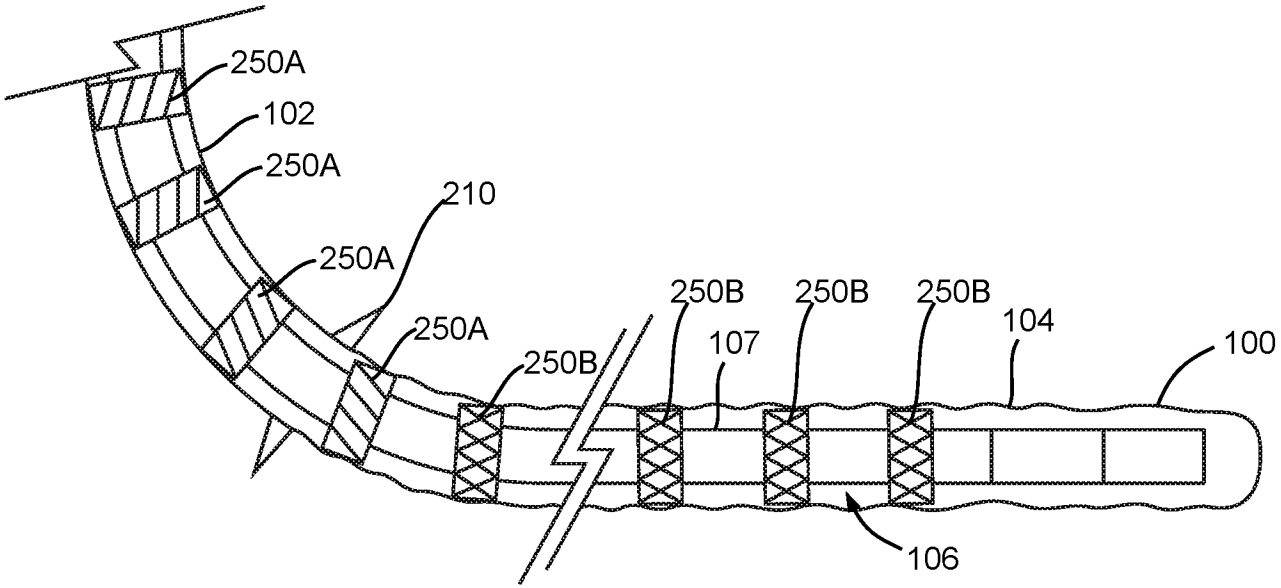
FIG. 20 shows a drilling operation using resilient/hard protrusion centralizers of FIGS. 17A and 17B, and/or FIGS. 18A and 18B, a mud motor and bent sub, the drilling operation continuing out of the cased wellbore portion and into an openhole horizontal section, according to an alternative embodiment.

In an embodiment as shown in FIG. 20, a drill string 106 may be equipped with one or more resilient/hard protrusion centralizers 250A and 250B spaced axially therealong. In particular, all the resilient/hard protrusion centralizers 250A and 250B are the resilient/hard protrusion centralizer(s) 220 of FIGS. 17A and 17B, the resilient/hard protrusion centralizer(s) 230 of FIGS. 18A and 18B, the resilient/hard protrusion centralizer(s) 240 of FIGS. 19A and 19B, or a combination thereof.

During drilling, the centralizers 250A in the casing portion 102 protect the casing. With drilling advance, some centralizers 250A move into the openhole portion 104, and the outermost resilient layer 222 of the resilient protrusions 120A may be worn or damaged (such centralizers being denoted in FIG. 20 as 250B). The radial extent of the resilient protrusions 120A are then sized or sacrificed, such that the hard protrusion(s) 120B are then exposed, preventing the centralizers 250B from being damaged. By using the resilient/hard protrusion centralizers 250A and 250B, there is no need to replace the centralizers in the openhole portion 104 unless they are damaged.

Figure 21:
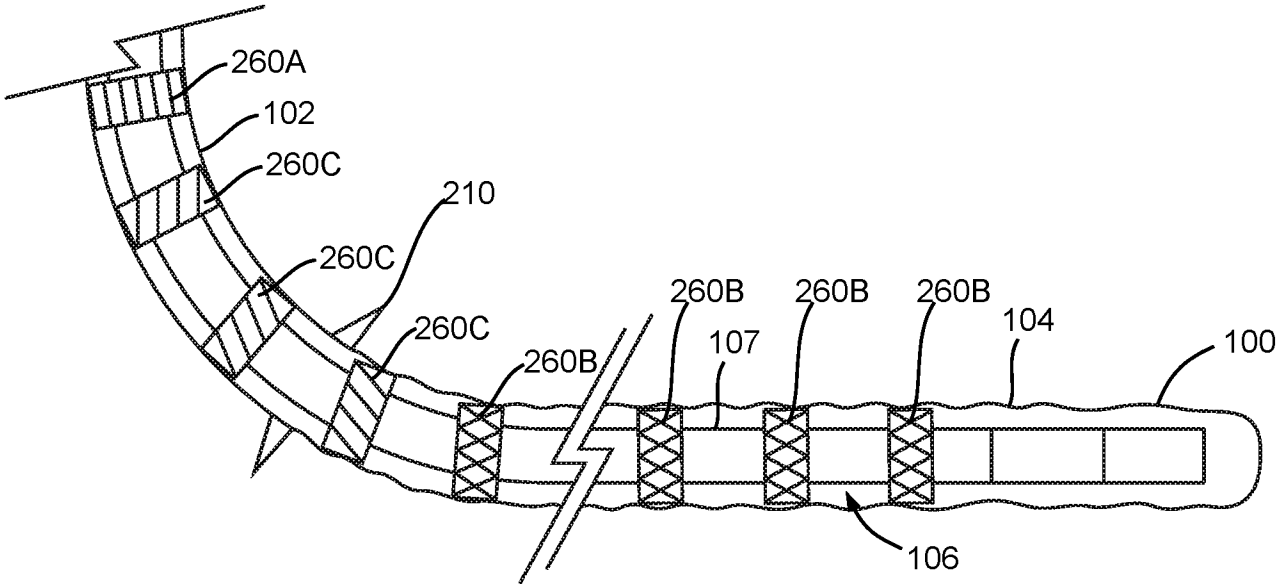
FIG. 21 shows a drilling operation using resilient/hard protrusion centralizers of FIGS. 17A and 17B, and/or FIGS. 18A and 18B, a mud motor and bent sub, the drilling operation continuing out of the cased wellbore portion and into an openhole horizontal section, according to another embodiment.

In another embodiment as shown in FIG. 21, a drill string 106 may be equipped with one or more centralizers 260A, 260B and 260C spaced axially therealong. In particular, centralizer(s) 260A are within the casing portion 102 during the entire drilling process, and therefore, may be any above-described resilient protrusion centralizer 110 or resilient/hard protrusion centralizer(s) 220, 230 and/or 240. The centralizer(s) 260B are within the openhole portion 104 during the entire drilling process, and therefore, may be any above-described hard protrusion centralizer 111 or resilient/hard protrusion centralizer(s) 220, 230 and/or 240.

The centralizer(s) 260C are transition centralizer(s), which may be any above-described resilient/hard protrusion centralizer(s) 220, 230 and/or 240. The transition centralizer(s) 260C are initially within the casing portion 102. With the drilling progress, the centralizers 260C are initially in the casing portion 102, protecting the casing. With drilling advance, some or all of centralizers 260C move into the openhole portion 104, and the outermost resilient layer 222 may be worn or damaged. The hard protrusion(s) 120B are then exposed, preventing the centralizers 260C from being damaged. Consequently, there is no need to replace the centralizers in the openhole portion 104 unless they are damaged.

In practice, the drill string 106 is usually pulled out of hole only for important services such as replacing worn drilling bit, replacing failed Measurement-while-Drilling (MWD) tools, failed mud motor, or having reached the total depth (meaning the drilling process being completed). However, replacing centralizers is usually not considered an important service. Therefore, as the process shown in FIG. 19 or 20 does not need to replace the centralizers (from resilient protrusion centralizers to hard protrusion centralizers or vice versa), it reduces the risk of damaging the casing, and the risk of damaging the drill string 106 or biasing from planned drilling direction due to damaged centralizer(s), and saves time and expense.

Rotary steerable systems are recently used in more and more applications of drilling horizontal wellbores. As is known in the art, compared to traditional drilling systems, rotary steerable systems can drill a much straighter wellbore, which is critical and required for drilling long horizontal wells, such as those of one mile to two miles long. Longer horizontal wells generally provide better production and lower well cost per barrel produced.

However, as the drill pipe in a rotary steerable system rotates all the time, casing wear caused by centralizers in rotary steerable systems is a more serious issue than that in traditional drilling system. The centralizers disclosed herein are suitable for rotary steerable systems in reducing or preventing casing wear, and in reducing or preventing centralizer damage.

Figure 22:
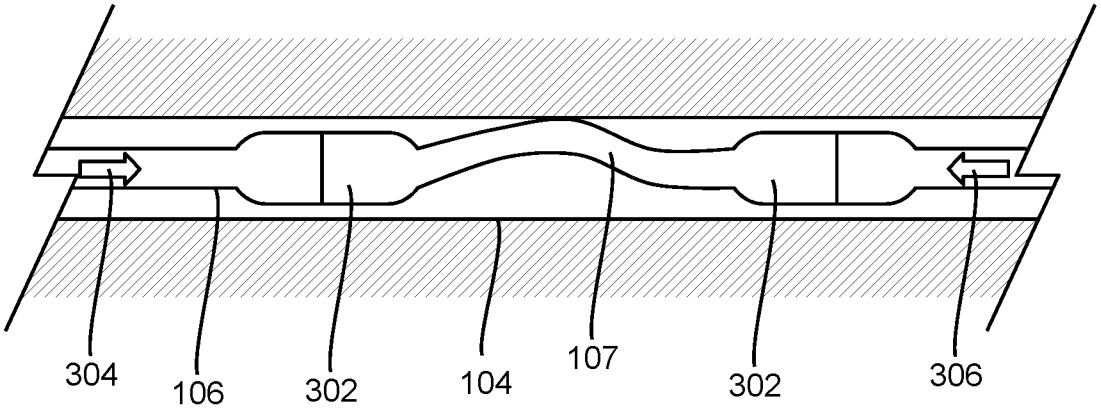
FIG. 22 shows a drilling operation when the drill string is buckled due to the uphole compression forces from the drill bit and the downhole compression force from the drill rig.

As shown in FIG. 22, in wellbore drilling practice, a drill pipe 107 of the drill string 106 between drill pipe tool joints 302 may be buckled or warped due to the uphole compression forces 304 from the drill bit at the downhole side of the drill string 106, and the downhole compression force 306 from the drill rig at the uphole side thereof. Traditionally, expensive, specially designed drill pipes are used to combat the buckling. However, the centralizers disclosed herein may be used for combating the buckling with lower cost.

In above embodiments, hard protrusions are formed by radially outwardly extending the support body 116. In an alternative embodiment, hard protrusions are formed separately from the support by 116, by using suitable material with sufficient stiffness.

In the embodiments of FIGS. 17A to 19B, some resilient protrusions are formed by covering a resilient layer onto respective hard protrusions. In some alternative embodiments, some resilient protrusions are formed by first coating the respective hard protrusions with stiff or wear-resistant material and then covering the respective coated hard protrusions with a resilient layer.

Although embodiments have been described above with reference to the accompanying drawings, those of skill in the art will appreciate that variations and modifications may be made without departing from the scope thereof as defined by the appended claims.

What is claimed is:

1. A centralizer for installing about a tubular, the centralizer comprising:

a resilient inner sleeve arranged circumferentially about the tubular, the inner sleeve having opposing axial ends and a central bore adapted for slidably receiving the tubular therein;

a tubular outer support body arranged circumferentially about the inner sleeve, the outer support body forming opposing axial ends, a body central bore for receiving the inner sleeve therein and one or more protrusions extending radially outwardly therefrom for engaging the wall of a wellbore, and for spacing the tubular from the wellbore; and a pair of annular end collars configured to secure to the tubular at opposing axial ends of the support body for preventing axial movement of the support body therebetween, each of the end collars having an annular overlap portion having a first diameter section for overlapping a portion of the respective axial ends of the support body and the inner sleeve respectively, the annular overlap portion preventing outward radial movement of the axial ends of the support body from about the tubular; and a clamping bore portion having a second diameter section for engaging the tubular, the second diameter section being smaller than the first diameter section and corresponding to a diameter of the tubular, wherein, when the pair of end collars are installed to the tubular, the axial ends of the support body and the inner sleeve are received within the respective first diameter sections and the second diameter sections form stop shoulders therebetween.

2. The centralizer of claim 1 wherein the resilient inner sleeve is a cylindrical tubular extending axially beneath the outer support body forming an annular gap between the resilient inner sleeve and the support body.

3. The centralizer of claim 1 wherein the resilient inner sleeve is contour-fit to the one or more protrusions in the outer support body for supporting the one or more protrusions.

4. The centralizer of claim 1 wherein the resilient inner sleeve is a two part sleeve, one part extending partially beneath each opposing axial end of the outer support body.

5. The centralizer of claim 1 wherein at least the one or more protrusions are further covered by a layer of wear-resistant material.

6. The centralizer of claim 5, wherein the wear resistant material is tungsten carbide.

7. The centralizer of claim 1, wherein the support body is made of metal.

8. The centralizer of claim 1, wherein the inner sleeve is made of a polymer.

9. The centralizer of claim 8, wherein the inner sleeve is made of polyurethane.

10. The centralizer of claim 1 wherein the resilient inner sleeve comprises two or more arcuate, inner sleeve segments, the two or more inner sleeve segments being arranged in a radial array about the tubular and forming at least two longitudinal discontinuous joints along the inner sleeve; and the tubular outer support body comprises two or more arcuate segments arranged in a radial array about the inner sleeve segments and forming at least two longitudinal discontinuous joints along the support body.

11. The centralizer of claim 10 wherein the annular overlap portion overlaps a portion of the respective axial ends of the at least two longitudinal discontinuous joints in the support body and the inner sleeve respectively.

12. The centralizer of claim 10 wherein, when the pair of end collars are installed to the tubular, the axial ends of the at least two longitudinal discontinuous joints in the support body and the inner sleeve are received within the respective first diameter sections.

* * * * *